US008826483B2

(12) United States Patent
Rutkowski et al.

(10) Patent No.: US 8,826,483 B2
(45) Date of Patent: Sep. 9, 2014

(54) FEED CONTROL LOCK FOR HAND OPERATED DRAIN CLEANER

(71) Applicant: Emerson Electric Co., St. Louis, MO (US)

(72) Inventors: Michael J. Rutkowski, Brunswick, OH (US); Paul W. Gress, Bay Village, OH (US); Jon R. Dunkin, Elyria, OH (US)

(73) Assignee: Emerson Electric Co., St. Louis, MO (US)

( * ) Notice: Subject to any disclaimer, the term of this patent is extended or adjusted under 35 U.S.C. 154(b) by 57 days.

(21) Appl. No.: 13/680,453

(22) Filed: Nov. 19, 2012

(65) Prior Publication Data

US 2013/0160227 A1 Jun. 27, 2013

Related U.S. Application Data

(60) Provisional application No. 61/578,270, filed on Dec. 21, 2011.

(51) Int. Cl.

| | |
|---|---|
| ***B08B 9/04*** | (2006.01) |
| ***B08B 9/045*** | (2006.01) |
| ***E03F 9/00*** | (2006.01) |
| ***G05G 5/00*** | (2006.01) |
| ***B08B 9/043*** | (2006.01) |

(52) U.S. Cl.

CPC ..... *B08B 9/0436* (2013.01); *B08B 9/045* (2013.01); *E03F 9/005* (2013.01); *G05G 5/005* (2013.01); *G05G 5/00* (2013.01)

USPC ..... 15/104.33; 242/395; 254/134.3 FT

(58) Field of Classification Search

USPC ..... 15/104.33; 242/395, 395.1; 254/134.3 FT

See application file for complete search history.

(56) References Cited

U.S. PATENT DOCUMENTS

| | | | | | |
|---|---|---|---|---|---|
| 2,042,407 | A | * | 5/1936 | Kugelman | 15/104.33 |
| 2,102,917 | A | | 12/1937 | Rolland | |
| 2,223,005 | A | | 11/1940 | Kerber | |
| 2,482,345 | A | | 9/1949 | Kincaid | |
| 2,661,489 | A | | 12/1953 | Rudolph et al. | |
| 2,769,191 | A | * | 11/1956 | Hunt et al. | 15/104.33 |
| 2,819,481 | A | | 1/1958 | Lockert | |
| 3,086,234 | A | | 4/1963 | Crane | |
| 3,206,782 | A | | 9/1965 | Larsen | |
| 3,224,024 | A | * | 12/1965 | Hunt | 15/104.33 |
| 3,449,782 | A | * | 6/1969 | Hunt | 15/104.33 |
| 3,897,602 | A | | 8/1975 | Waterbury | |
| 4,153,966 | A | * | 5/1979 | Irwin | 15/104.33 |
| 4,361,924 | A | * | 12/1982 | Irwin | 15/104.33 |

(Continued)

*Primary Examiner* — Mark Spisich

(74) *Attorney, Agent, or Firm* — Mark E. Bandy; Rankin, Hill & Clark LLP

(57) ABSTRACT

A hand operated drain cleaner includes a manually operated rotatable drum and an elongated flexible cable at least partially held in the drum. A portion of the cable extending from the drum has a cable axis, and rotation of the drum rotates the cable portion about the cable axis. A handle is adapted to rotatably support the drum. The handle includes a barrel portion and a handle portion. A feed control device includes a housing having a feed passage axially therethrough for receiving the cable and a trigger for moving the feed control device between a non-actuating position and an actuating position. In the actuating position, a feed control device is pivoted relative to the handle such that the driving mechanism engages the cable thereby inducing axial movement of the cable via rotation of the drum. A locking mechanism is opera operably associated with the feed control device.

24 Claims, 22 Drawing Sheets

(56) References Cited

U.S. PATENT DOCUMENTS

| | | | | |
|---|---|---|---|---|
| 4,956,889 | A | 9/1990 | Kirk | |
| 5,029,356 | A | 7/1991 | Silverman et al. | |
| 5,414,888 | A * | 5/1995 | Irwin | 15/104.33 |
| 5,640,736 | A | 6/1997 | Salecker | |
| 5,901,401 | A | 5/1999 | Rutkowski et al. | |
| 6,158,076 | A * | 12/2000 | Rutkowski et al. | 15/104.33 |
| 6,470,525 | B1 | 10/2002 | Silverman | |
| 7,367,077 | B2 | 5/2008 | Rutkowski et al. | |
| 2011/0191969 | A1 | 8/2011 | Wildauer et al. | |

* cited by examiner

FEED CONTROL LOCK FOR HAND OPERATED DRAIN CLEANER

CROSS REFERENCES TO RELATED APPLICATIONS

This application claims priority upon U.S. provisional patent application Ser. No. 61/578,270 filed Dec. 21, 2011.

BACKGROUND

Exemplary embodiments herein generally relate to a drain cleaner or auger, and, more particularly, relate to a feed control device for a manual or hand operated drain cleaner or auger.

Relatively small, portable drain cleaners are well known and, generally include a drain cleaning snake or cable coiled in a housing or drum from which an end of the cable extends for introduction into a drain or sewer line to be cleaned. For hand held and hand operated drain cleaners, a crank is attached to the drum to allow a user to rotate the drum about a support assembly from which a handle depends. The cable extends forwardly of the drum and is extended relative thereto for insertion into the drain to be cleaned and rotates with the drum so as to clear a blockage encountered in the drain. A user withdraws a length of the cable from the drum until a snag or obstruction in a drain is reached. As is well known, the cable can be advanced out of the drum and into a drain through the use of a cable feeding device attached to the drum. The cable feeding device includes a driving mechanism which can selectively engage the cable so that rotation of the drum causes axial movement of the cable. When the drain cleaning operation is completed, the cable is moved back into the drum by the user via engagement of the cable with the driving mechanism and rotation of the drum. In some known hand operated drain cleaners, a pistol grip type handle extends laterally of the axis of rotation for supporting the drum. For those drain cleaners including the cable feeding device, constant pressure by the user has to be applied to the cable feeding device to maintain the engagement between the driving mechanism and the cable. However, this requires one hand to apply the constant pressure and the other hand to rotate the drum. Because of the constant pressure that has to be applied to the cable feeding device to affect axial movement of the cable, drain cleaners of this type can render a drain cleaning operation tedious.

BRIEF DESCRIPTION

In accordance with one aspect, a manual or hand operated drain cleaner comprises a manually operated rotatable drum and an elongated flexible cable at least partially held in the drum. A portion of the elongated flexible cable extending from the drum has a cable axis, and rotation of the drum rotating the cable portion about the cable axis. A handle is adapted to rotatably support the drum. The handle includes a barrel portion and a handle portion. The barrel portion includes a bore axially therethrough for receiving the cable. A feed control device is pivotally connected to the handle. The feed control device includes a housing having a feed passage axially therethrough for receiving the cable and a trigger for moving the feed control device between a non-actuating position and an actuating position. A driving mechanism is operably associated with one of the handle and the feed control device for selectively engaging the cable. In the actuating position, the feed control device is pivoted relative to the handle such that the driving mechanism engages the cable thereby inducing for axial movement of the cable via rotation of the drum. A locking mechanism is operably associated with the feed control device. The locking mechanism is moveable between a lock position where the feed control device is locked in the actuating position and an unlocked position where the feed control device is freely moveable between the non-actuating position and actuating position.

In accordance with another aspect, a manual or hand operated drain cleaner comprises a manually operated rotatable drum and an elongated flexible cable at least partially held in the drum. A portion of the elongated flexible cable extending from the drum has a cable axis, and rotation of the drum rotating the cable portion about the cable axis. A handle is adapted to rotatably support the drum. A feed control device is pivotally connected to the handle. The feed control device is moveable between a non-actuating position and an actuating position. A driving mechanism is operably associated with one of the handle and the feed control device for selectively engaging the cable. In the actuating position, the feed control device is pivoted relative to the handle such that the driving mechanism engages the cable thereby inducing for axial movement of the cable via rotation of the drum. A locking mechanism is operably associated with the feed control device. The locking mechanism is moveable between a lock position where the feed control device is locked in the actuating position and an unlocked position where the feed control device is freely moveable between the non-actuating position and actuating position. The locking mechanism includes a locking member having a ramp portion adapted to engage one of the handle and the feed control device and maintain the feed control device in the actuating position.

In accordance with yet another aspect, a locking mechanism for a manual or hand operated drain cleaner is provided. The drain cleaner includes a manually operated rotatable drum for holding an elongated flexible cable and rotating a portion of the cable extending from the drum about the cable axis. A handle is adapted to rotatably support the drum. A feed control device is pivotally connected to the handle and movable between a non-actuating position and an actuating position. A driving mechanism engages the cable and allows for axial movement of the cable via rotation of the drum in the actuating position of the feed control device. The locking mechanism comprises a locking member configured to move between a lock position where the feed control device is locked in the actuating position and an unlocked position where the feed control device is freely moveable between the non-actuating position and actuating position. The locking member has a ramp portion adapted to engage one of the handle and the feed control device and maintain the feed control device in the actuating position.

DETAILED DESCRIPTION

Figure 1:
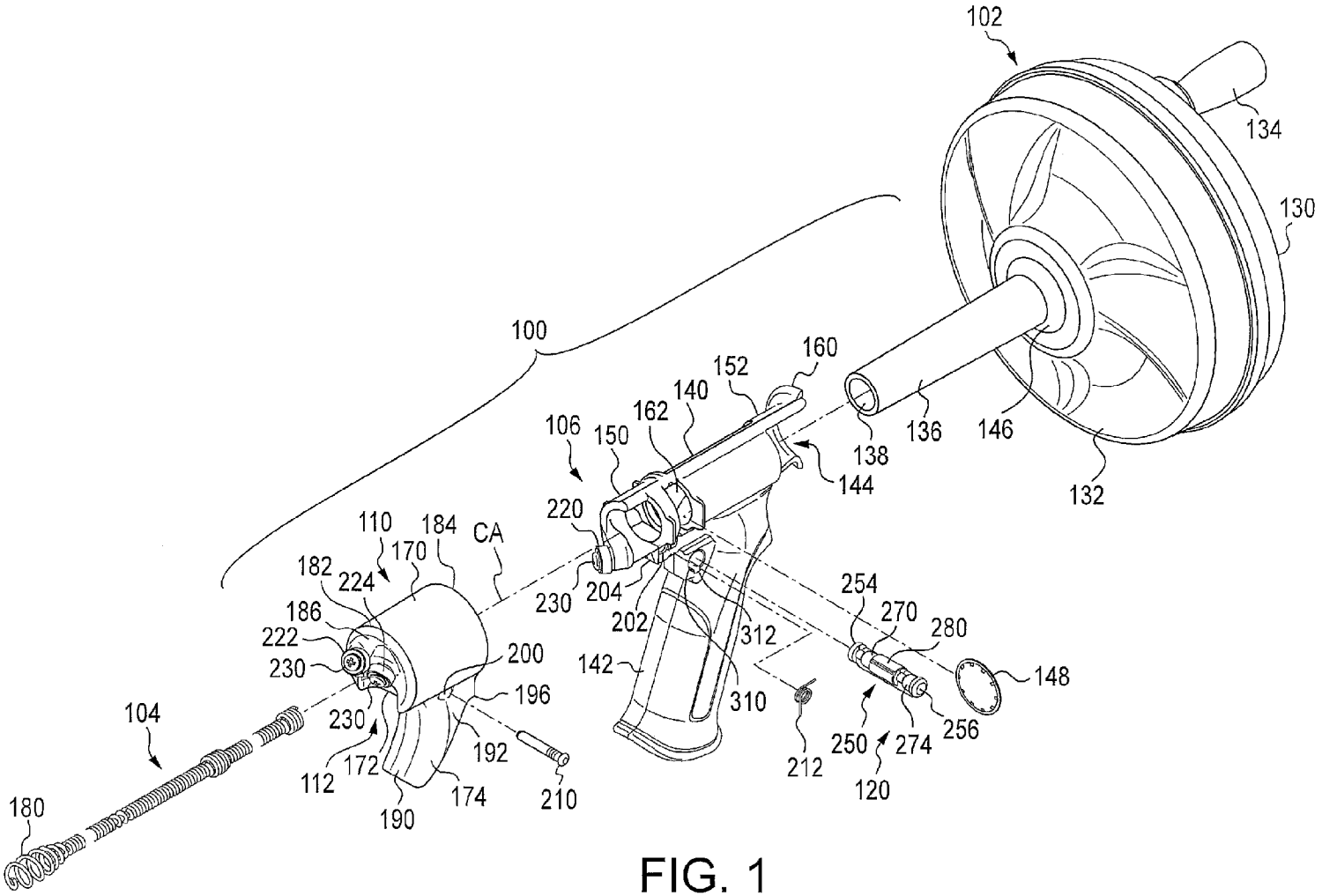
FIG. 1 is an exploded perspective view of a manual or hand operated drain cleaner or auger, the drain cleaner including a manually operated rotatable drum for holding and rotating a cable, a handle, a feed control device, a driving mechanism and a locking mechanism.

It should, of course, be understood that the description and drawings herein are merely illustrative and that various modifications and changes can be made in the structures disclosed without departing from the present disclosure. In general, the figures of the exemplary manual or hand operated drain cleaner are not to scale. It should be appreciated that the various identified components of the exemplary manual or hand operated drain cleaner disclosed herein are merely terms of art that may vary from one manufacturer to another and should not be deemed to limit the present disclosure.

Referring now to the drawings, wherein like numerals refer to like parts throughout the several views, FIGS. 1-4 illustrate a manual or hand operated drain cleaner or auger 100 in accordance with the present invention for cleaning a drain or sewer line. The drain cleaner 100 comprises a manually operated rotatable drum 102 for holding an elongated flexible cable or snake 104. A portion of the cable 104 is coiled within the drum 102 and a portion of the cable extending from the drum 102 is rotatable about a cable axis CA via rotation of the drum. A handle 106 is adapted to rotatably support the drum. A feed control device 110 is pivotally connected to the handle. A driving mechanism 112 is operably associated with one of the handle 106 and the feed control device 110 for selectively engaging the cable 104. A locking mechanism 120 is operably associated with the feed control device 110. As will be discussed in greater detail below, the locking mechanism 120 is movable between a locked position where the feed control device 110 is locked in an actuating position and an unlocked position where the feed control device 110 is freely movable between a non-actuating position and the actuating position. Thus, the locking mechanism 120 selectively locks the feed control device 110 in the actuating position so that maintenance of a user-applied force is not required.

Particularly, the manually operated rotatable drum 102 includes a first side 130 and a second side 132 removably connected to the first side to provide access to the cable 104 coiled within the drum 102. The first side 130 includes a crank handle 134 connected thereto. The crank handle 134 allows a user to rotate the drum 102 in either a clockwise or counterclockwise direction depending on the intended use of the drain cleaner 100. A conduit 136 extends outwardly from the second surface 132 of the drum. The conduit is centrally located on the drum such that a longitudinal axis of the conduit is coaxial with a rotational axis defined by the drum 102 (i.e., the cable axis CA). The conduit 136 includes an elongated through-hole 138 for receipt of the cable 104. The drum 102 is rotatably supported by the conduit 136 that extends into the handle 106.

The handle 106 includes a barrel portion 140 and a handle portion 142. The barrel portion 140 includes a bore 144 axially therethrough for receiving the conduit 136. It should be appreciated that the conduit is fixed to the drum 102 and, therefore, does not rotate with the drum. A ring retainer 148 can be provided to secure the conduit 136 within the bore 144 of the barrel portion 140 in a cut out located in the barrel portion; although alternative manners for retaining the conduit are contemplated. The barrel portion 140 further includes a first end portion 150 and a second end portion 152. The first end portion 150 is configured to be at least partially received in the feed control device 110. The second end portion 152 can include a radial flange 160 which abuts a radius 146 provided on the second surface 132 of the drum 102 in an assembled condition of the drain cleaner 100. A cutout 162 is located on the barrel portion near the first end portion for receipt of the ring retainer 148. The handle portion 142 extends downwardly from the barrel portion 140 and is canted relative to a longitudinal axis defined by the barrel portion 140.

The feed control device 110 includes a housing 170 having a feed passage 172 axially therethrough and a trigger 174 for moving the feed control device 110 between the non-actuating position and the actuating position. The feed passage 172 receives the cable 104 which is adapted to be axially fed relative to the handle 106 and feed control device 110. As is conventional, the cable 104 is made of tightly wound spring wire and, in the illustrated embodiment, the wire at the free or outer end thereof is formed to provide an auger tip 180 which is radially enlarged relative to the remainder of the cable 104. The housing 170 further includes a first end portion 182 and a second end portion 184. An end wall 186 is provided at the first end portion 182. As will be discussed below, a part of the driving mechanism 112 is located on the end wall 186. The first end portion 150 of the handle 106 is mounted to the second end portion 184 of the housing 170. The trigger 174 is located beneath the housing 170 and includes a curved end wall 190 and a pair of side walls 192, 194. A lower portion of each side wall 192, 194 includes a generally planar edge section 196, 198.

As indicated above, the feed control device 110 is pivotally connected to the handle 106 which allows the feed control device to move between the non-actuated position and the actuated position. To that end, the feed control device 110 includes a through-hole 200 which extends between the side walls 192, 194. The handle 106 includes a corresponding through-hole 202 located on a downwardly extending tab 204 provided at the first end portion 150 of the barrel portion 140. To connect the feed control device 110 to the handle 106, the first end portion 150 is positioned in the second end portion 184 of the housing 170 with the through-hole 200 being aligned with the through-hole 202. A pivot pin 210 extends through the through-holes 200, 202 to pivotally connect the feed control device 110 to the handle 106. A torsion spring 212 is mounted to the tab 204 adjacent the through-hole 202. The pin 210 also extends through the torsion spring, the torsion spring being adapted to bias the feed control device 110 toward the non-actuating position. Therefore, with this arrangement, the feed control device 110 is pivotable about an axis defined by the pin 210 between the non-actuating position where the trigger 174 is spaced farthest from the handle portion 142 and the actuating position where the trigger 174 is adjacent the handle portion 142.

Figure 2:
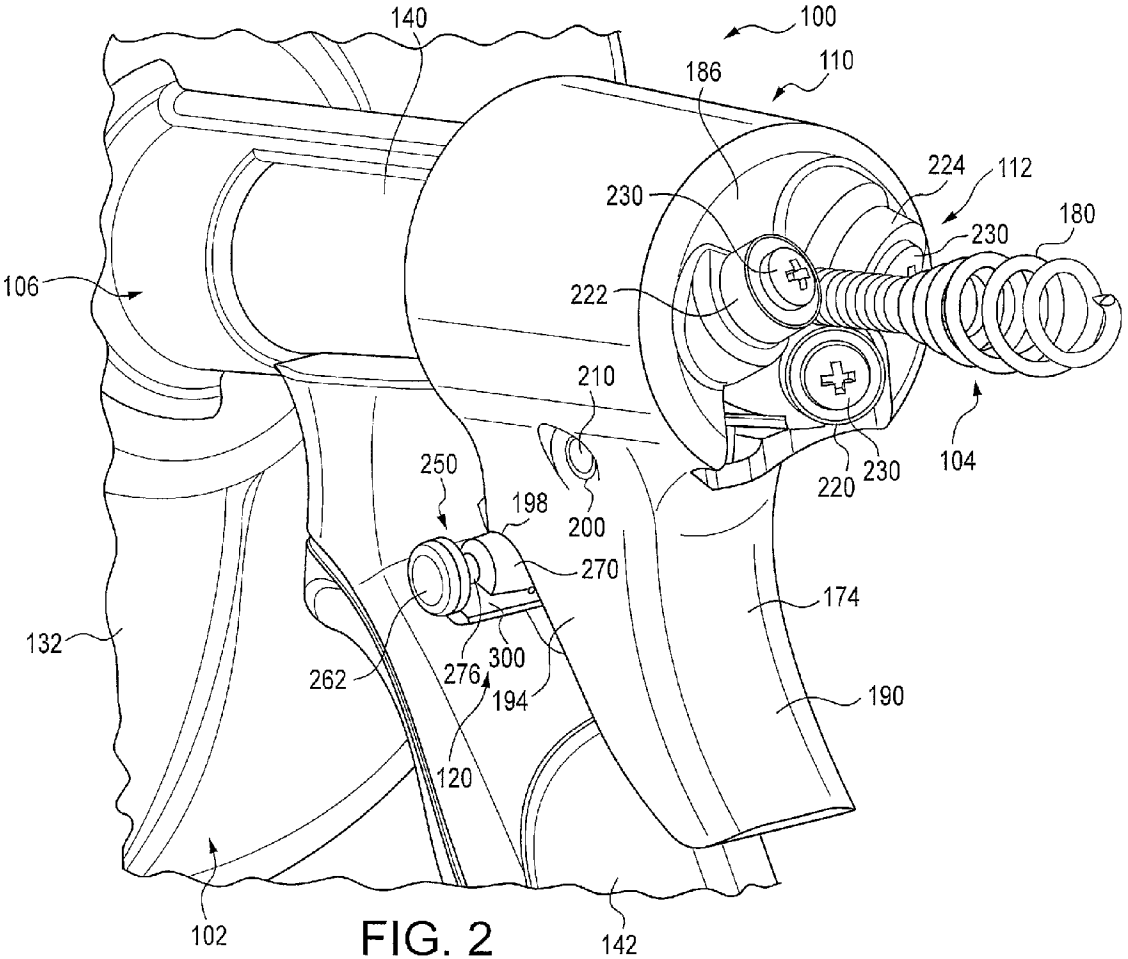
FIG. 2 is a partial side perspective view of the drain cleaner of FIG. 1 in an assembled condition, the drain cleaner being in a locked state via the locking mechanism.
Figure 3:
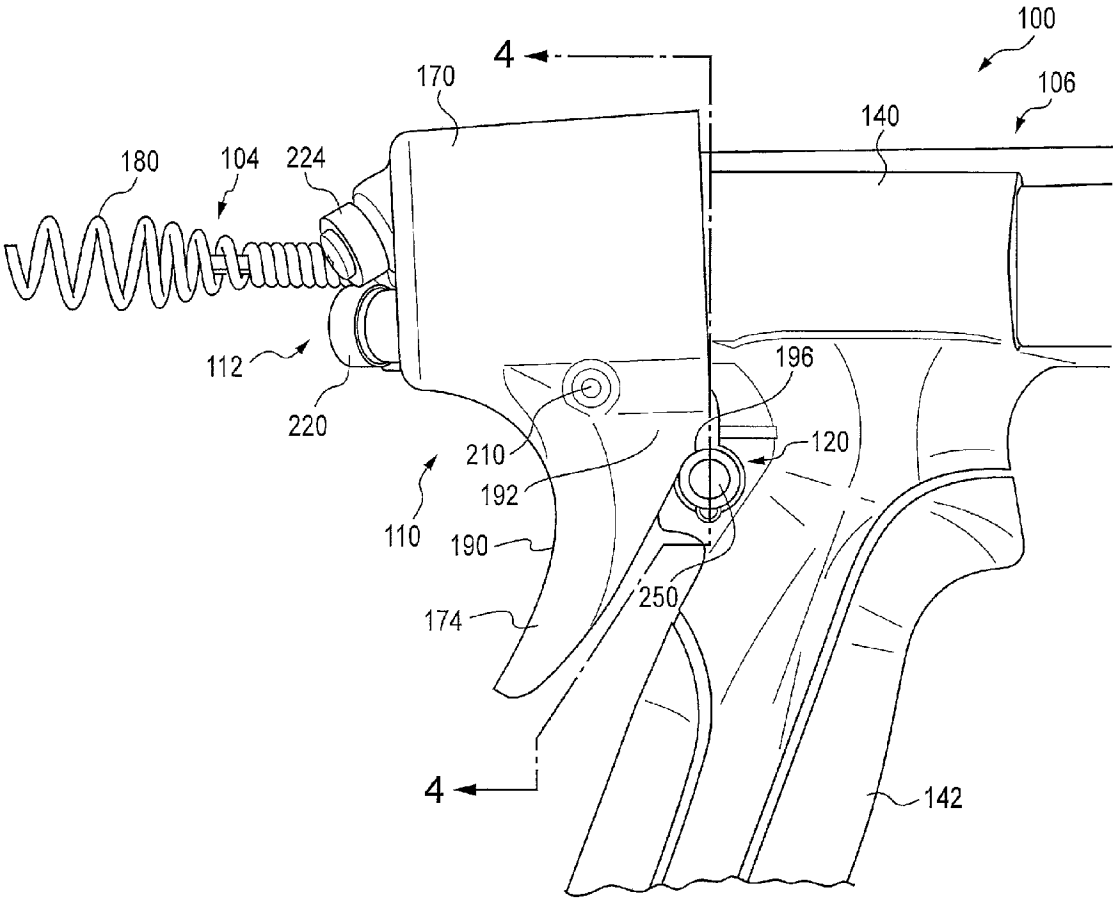
FIG. 3 is a side view of the drain cleaner of FIG. 2.

With continued reference to FIGS. 1-3, the driving mechanism 112 includes a drive actuating roll 220 mounted on one of the handle 106 and the feed control device 110 for rotation about an actuating roll axis and a pair of cable driving rolls 222, 224 each mounted on the other of the handle 106 and the feed control device 110 for rotation about a drive roll axis. Specifically, the drive actuating roll 220 is mounted on a lower portion of the end portion 150 of the barrel portion 140 of the handle 106. The cable driving rolls 222, 224 are mounted on the end wall 186 provided on the first end section 182 of the housing 170 of the feed control device 110. Conventional fasteners, such as the illustrated screws 230, mount each of the drive actuating roll 220 and cable driving rolls 222, 224 to the respective handle 106 and feed control device 110. The screws 230 define the actuating roll axis of the drive actuating roll 220 and the drive roll axes of the cable drive rolls 222, 224. As shown, the drive actuating roll 220 which is supported by the handle 106 can be skewed horizontally with respect to the cable axis CA (and the axis of the barrel portion 140) at an angle of about 30 degrees relative thereto. Each driving roll axis of the cable driving rolls 222, 224, which are secured on the feed control device 110, can be skewed both horizontally and vertically relative to the cable axis CA (and the axis of the housing 170) at an angle of about 30 degrees with respect to each other. The skewed mounting of each of the drive actuating roll 220 and the cable drive rolls 222, 224 provides for driving the cable 104 in a well-known manner when the cable is rotated about the cable axis CA via rotation of the drum 102 and displaced against the cable driving rolls 222, 224. Each of the rolls 220, 222, 224 has a smooth outer surface; although, this is not required. Further, and as will be appreciated from FIGS. 1-3, the cable driving rolls 222, 224 and the drive actuating roll 220 are equally spaced apart circumferentially about the cable axis CA.

In use, in the actuating position of the feed control device 110, the feed control device is pivoted relative to the handle 106 such that the driving mechanism 112 engages the cable 104 allowing for axial movement of the cable via rotation of the drum 102. More particularly, the cable 104 extends between the drive actuating roll 220 and the cable driving rolls 222, 224. Pivoting movement of the feed control device 110 via the trigger 174 from the non-actuating position to the actuating position displaces the pair of cable driving rolls 222, 224 toward the drive actuating roll 220. This, in turn, causes the cable 104 to be engaged by the drive actuating roll 220 and cable driving rolls 222, 224. Once engaged by the drive actuating roll and the cable driving rolls, the cable 104 is able to be axially fed through the handle 106 and feed control device 110. Upon release of the trigger 174, the trigger is biased away from the handle portion 142 via the torsion spring 212 about the pin 210. This causes the cable driving rolls 222, 224 to move away from engagement with the cable 104. The cable 104 is then able to rotate about its cable axis CA via rotation of the drum 102 without the cable being axially displaced. When it is desired to facilitate the feed or removal of the auger portion 180 of the cable 104 from the feed control device 110, the trigger 174 of the feed control device is again pivoted counterclockwise toward the handle portion 142 about the pin 210. When the user disengages the trigger 174, the feed control device 110 is pivoted clockwise away from the handle portion 142 about the pivot pin via the biasing force of the torsion spring 212.

As indicated above, rotation of the drum 102 via the crank handle 134 in one of a clockwise or counterclockwise direction causes the cable 104 extending through the barrel portion 140 of the handle 106, which is held by the user, to rotate relative to the handle 106. There is no actual displacement of the cable at this time in that the drive actuating roll 220 is disengaged from the cable 104. When the trigger 174 is displaced toward the handle portion 142, the cable is engaged by the cable driving rolls 222, 224 and the cable driving rolls displace the cable into engagement with the drive actuating roll 220. As a result of the skewed disposition of the drive actuating roll 220 and the pair of cable driving rolls 222, 224, engagement of the rolls 220, 222, 224 with the rotating cable 104 cause the latter to advance axially through the handle 106 and feed control device 110 in the direction relative to the feed control device which depends on the direction of rotation of the cable 104 via the drum 102. In this respect, rotation of the cable 104 in one direction advances the cable axially outwardly from the feed control device 110 while rotation of the cable in the opposite draws the cable 104 axially inwardly of the feed control device. When it is desired to stop axial displacement of the cable, the feed control device 110 is moved from the actuating position to the non-actuating position which disengages each of the drive actuating roll 220 and the cable driving rolls 222, 224 from the cable 104.

As set forth above, the locking mechanism 120 is movable between the locked position where the feed control device 110 is locked in the actuating position and the unlocked position where the feed control device 110 is freely movable between the non-actuating position and the actuating position. The locking mechanism 120 in the locked position maintains engagement between the drive actuating roll 220 and cable driving rolls 222, 224 and the cable 104 without a requirement of a user applying constant pressure on the trigger 174 to maintain the feed control device 110 in the actuating position.

With continued reference to FIGS. 1 and 2, and according to one aspect of the present disclosure, the locking mechanism 120 includes a locking member 250 movably connected to the handle 106. As best depicted in FIGS. 5-8, the locking member includes a body 252 having a first end portion 254 and a second end portion 256. Each respective end portion 254, 256 of the body 252 is provided with a radial flange 262, 264 which extends circumferentially about an outer surface of the body 252. The locking member 250 includes a ramp portion adapted to engage the feed control device 110 and maintain the feed control device in the actuating position. Particularly, in the depicted embodiment, the body 252 includes a first ramp portion 270 located near the first end portion 254 and a second ramp portion 274 located near the second end portion 256. The first ramp portion 270 is spaced from the first end portion 254 via a first circumferential groove 276. The second ramp portion 274 is connected to the flange 264 and is spaced from the first portion 270 via a second circumferential groove 278. An enlarged, centrally located section 280 is connected to the first ramp portion 270 and is spaced from the second ramp portion 274 via the second groove 278. The first ramp portion 270 has an increasing radial dimension as it extends from the first groove 276 toward the section 280. The second ramp portion 274 has an increased radial dimension as it extends from the second groove 278 toward the second flange 264. The section 280 further includes a ridge 290 which projects outwardly from the section 280 and extends along an axial length of the section 280. The locking member 250 further includes an elongated tab or key 300 which extends between the first and second end portions 254, 256 of the body 252.

To connect the locking member 250 to the handle 106, the handle includes a through-hole 310 and the locking member 250 is slidably received in the through-hole in a direction substantially perpendicular to the cable axis CA. The through-hole 310 has an axial dimension which is substantially equal to an axial dimension of the section 280 of the locking member 250 and a radial dimension sized to slidably receive the section 280. To prevent rotation of the locking member in the through-hole 310, the handle 106 further includes a key way 312 located in the through-hole 310. The locking member 250 includes the corresponding key 300 which is slidably received in the keyway.

Figure 4:
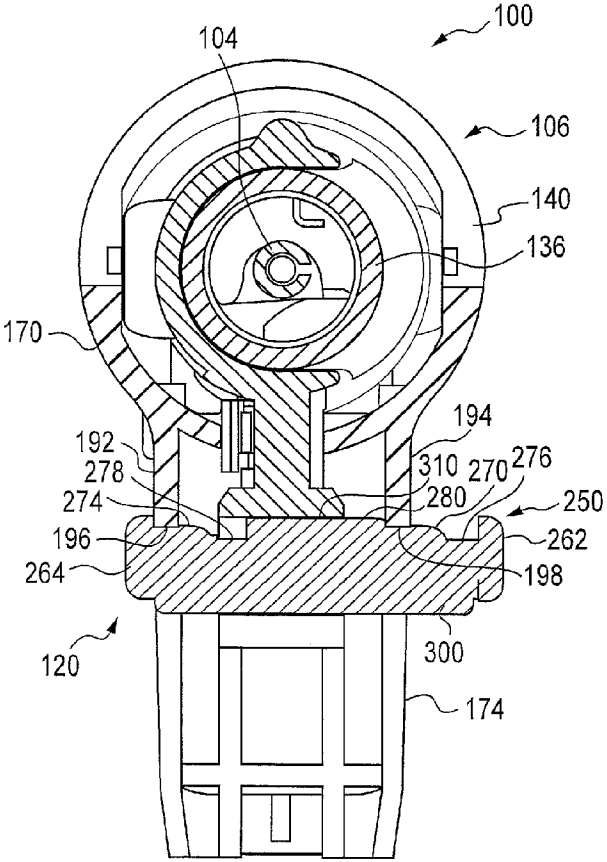
FIG. 4 is a cross-sectional view of the drain cleaner of FIG. 3 taken generally along line 4-4 of FIG. 3.
Figure 6:
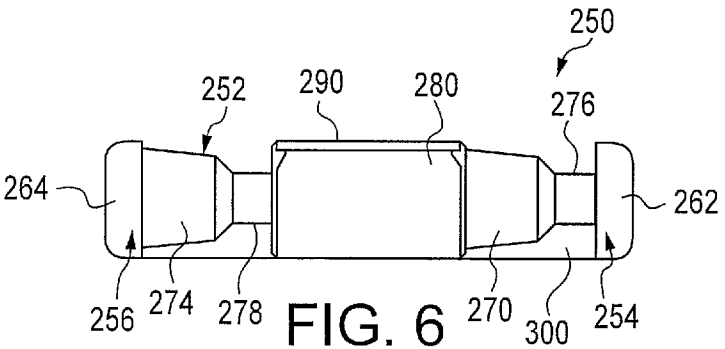
FIG. 6 is a top view of the locking member of FIG. 5.
Figure 7:
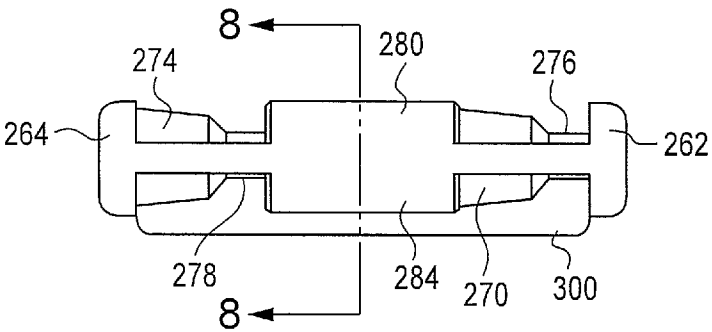
FIG. 7 is a front view of the locking member of FIG. 5.
Figure 8:
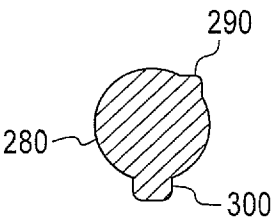
FIG. 8 is a cross-sectional view of the locking member of FIG. 7 taken generally along line 8-8 of FIG. 7.
Figure 5:
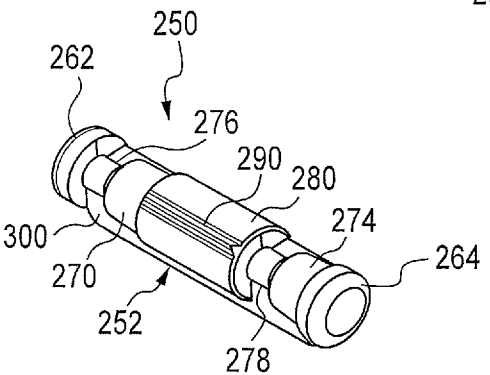
FIG. 5 is a perspective view of a locking member of the locking mechanism for the drain cleaner of FIG. 1 according to one aspect of the present disclosure.

As shown in FIGS. 2 and 4, the first ramp portion 270 and the second ramp portion 274 are adapted to engage the feed control device 110 and maintain the feed control device in the actuating position. Particularly, the section 280 is positioned in the through-hole 310 as the feed control device 110 is moved between the non-actuating position and the actuating position. In the position of the locking member 250, the first and second grooves 276, 278 are aligned with the side walls 194, 192 such that the edge sections 198, 196 are received in the first and second grooves 276, 278. With this embodiment of the locking mechanism 120, to maintain the feed control device 110 in the actuating position, the locking member 250 is axially moved in the through-hole 310 so that each of the first and second ramp portions 270, 274 engages a lower portion of the feed control device 110. As depicted, the first ramp portion 270 engages planar edge section 198 provided on side wall 194 and the second ramp portion 274 engages planar edge section 196 provided on side wall 192 of the trigger 174. This frictional engagement between the first and second ramp portions of the locking member 250 and the trigger 174 prevents the feed control device 110 from being biased back toward the non-actuating position via the torsion spring 212. To disengage the locking member 250 from the trigger 174, the trigger is slightly depressed inwardly toward the handle portion 142. This disengages the trigger 174 from the first and second ramp portion 270, 274. The locking member 250 can then be slid back through the through-hole 310 until the first and second grooves 276, 278 are aligned with the side walls 194, 192. A user can then release the trigger 174 which allows the feed control device 110 to move back toward the non-actuating position.

Figure 9:
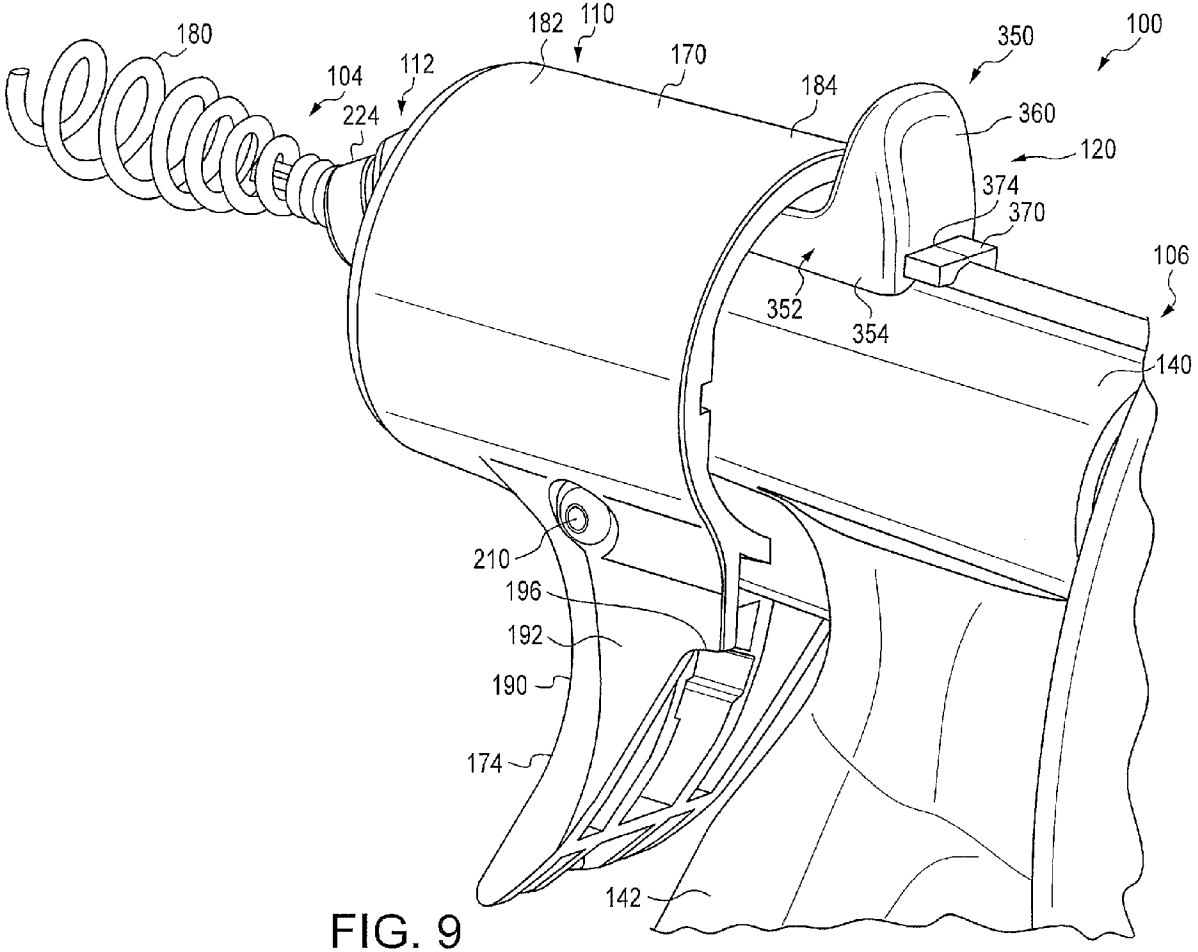
FIG. 9 is a partial side perspective view of the drain cleaner of FIG. 1 in an assembled condition, the drain cleaner being in a locked state via the locking mechanism including a locking member according to another aspect of the present disclosure.
Figure 10:
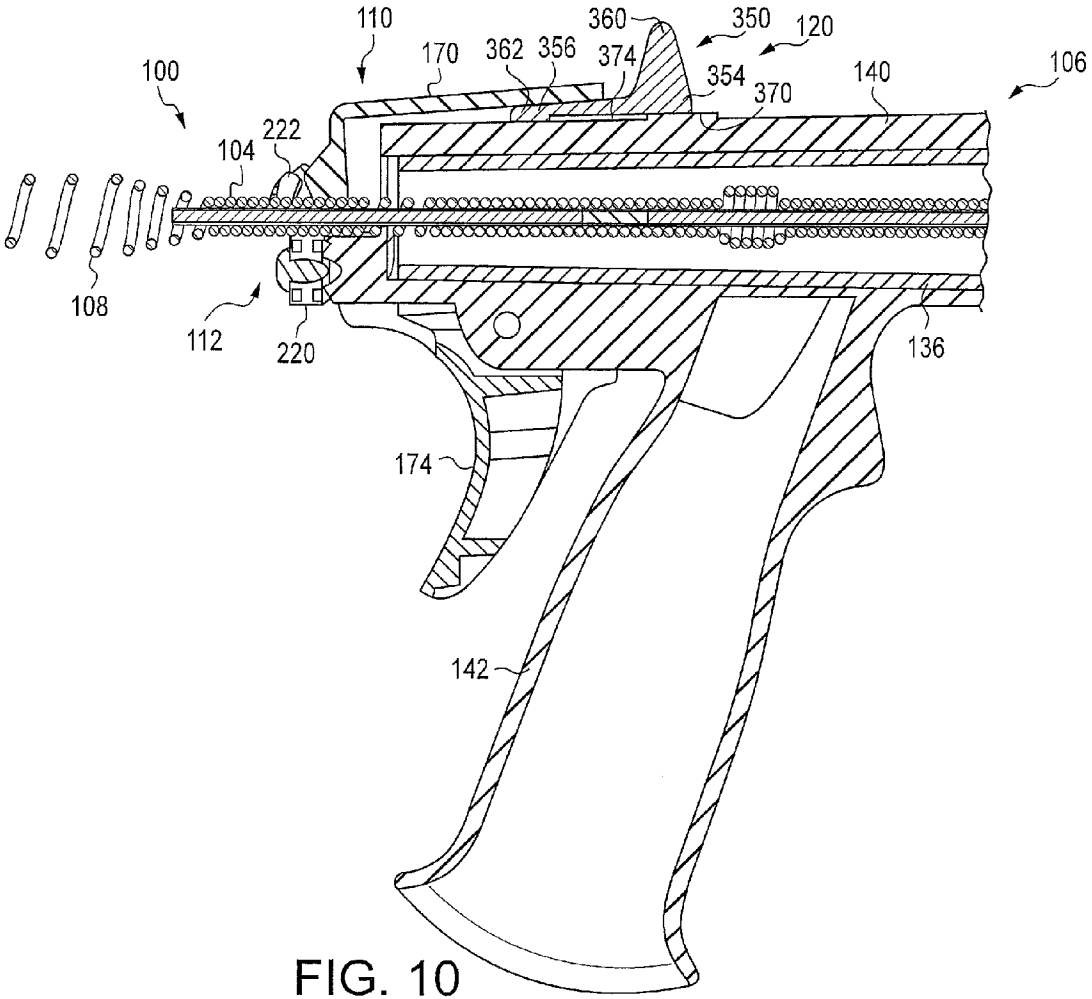
FIG. 10 is a cross-sectional view of the drain cleaner of FIG. 9.
Figure 11:
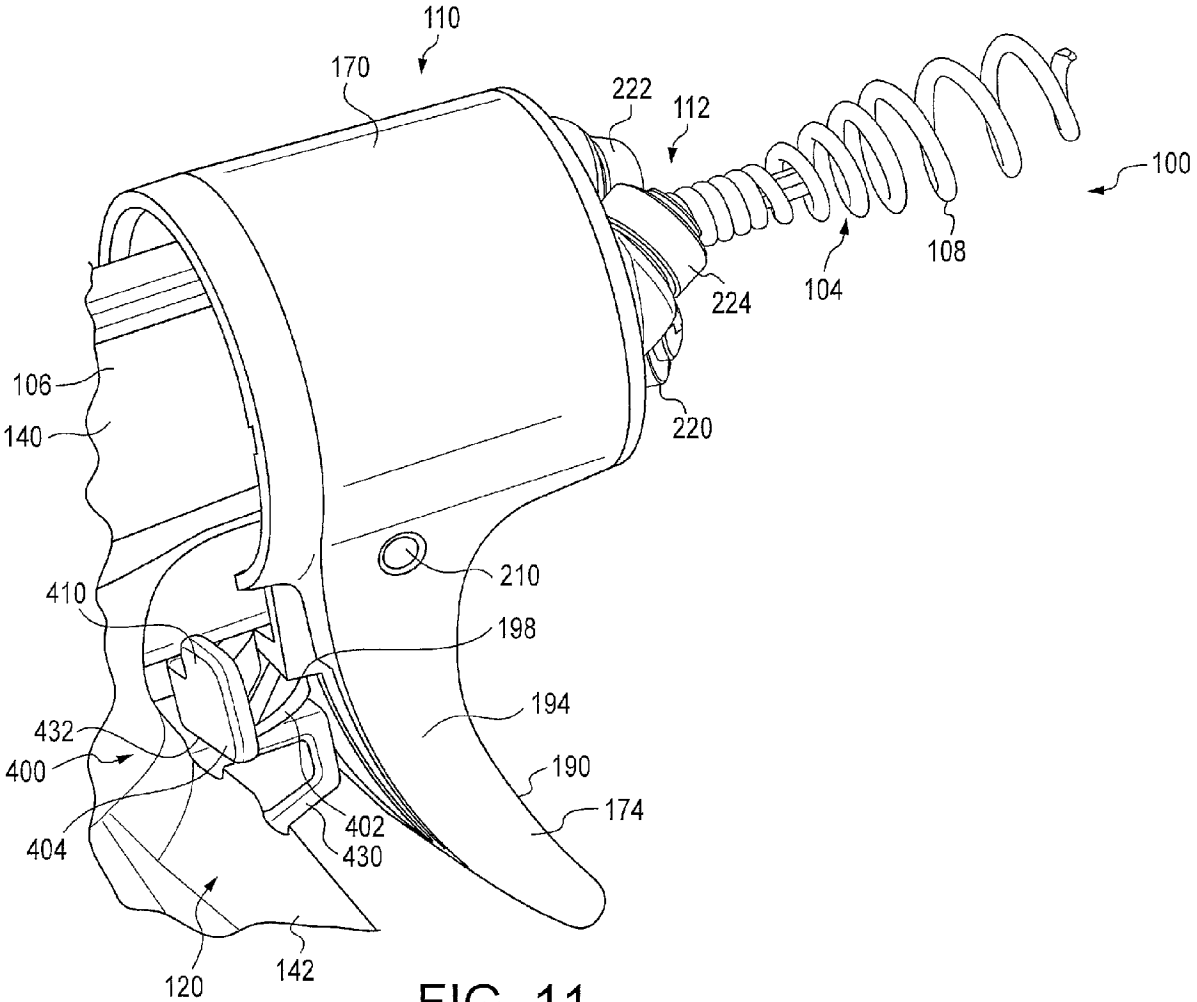
FIG. 11 is a partial side perspective view of the drain cleaner of FIG. 1 in an assembled condition, the drain cleaner being in an unlocked state, the locking mechanism including a locking member according to yet another aspect of the present disclosure.
Figure 12:
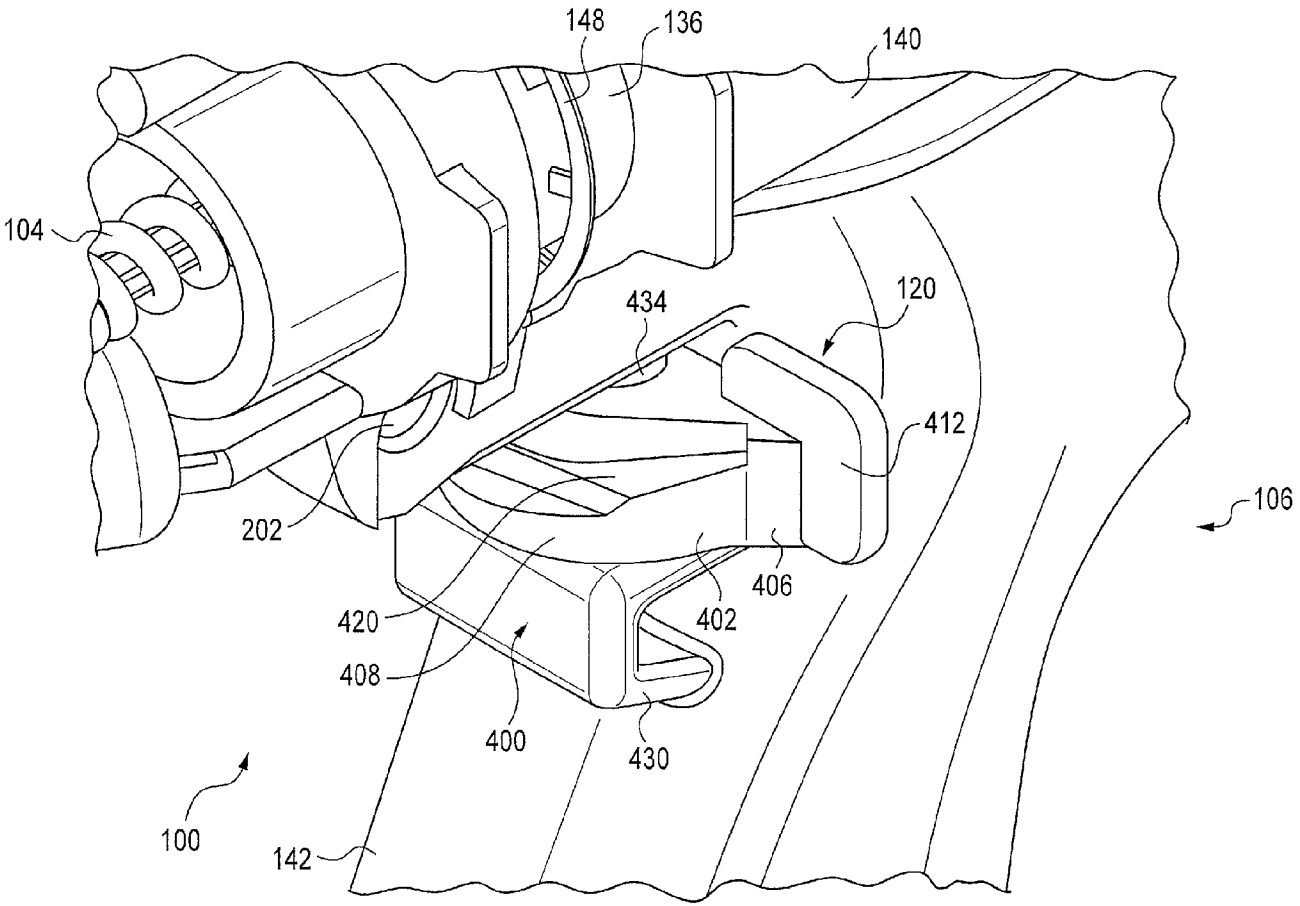
FIG. 12 is a partial front perspective view of the drain cleaner of FIG. 11.
Figure 13:
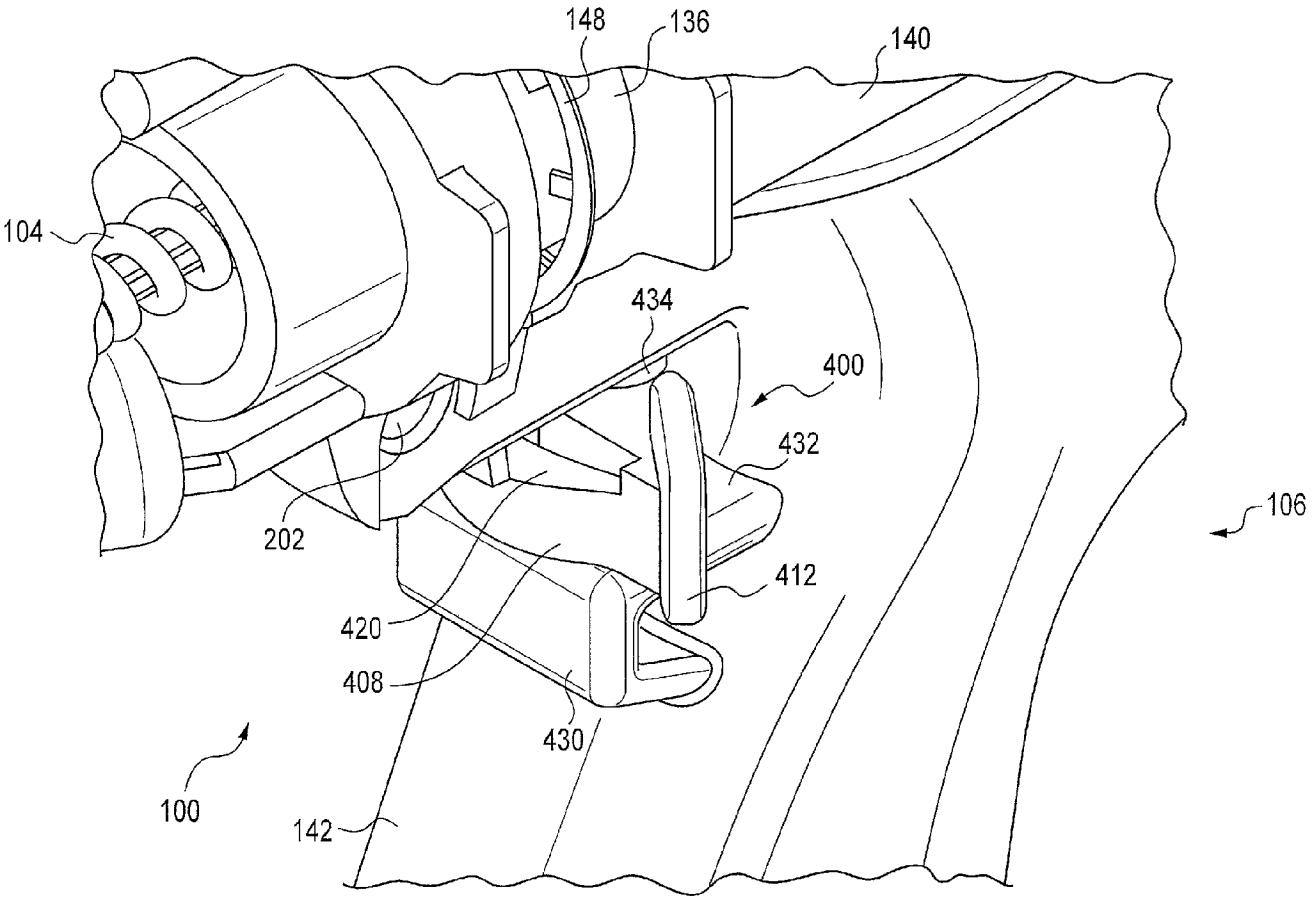
FIG. 13 is a partial front perspective view of the drain cleaner of FIG. 12 in a locked state via the locking member.
Figure 14:
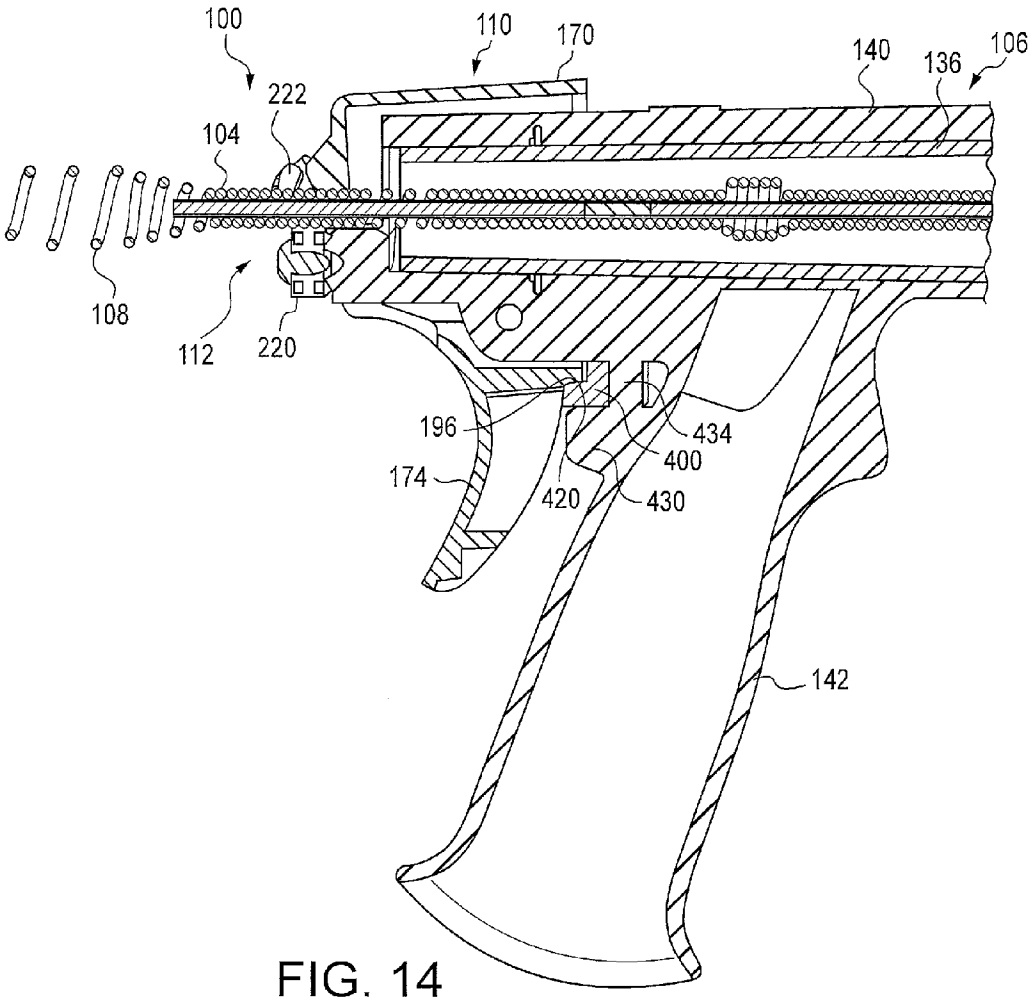
FIG. 14 is a cross-sectional view of the drain cleaner of FIG. 13.

FIGS. 9 and 10 depict a locking mechanism 120 according to another aspect of the present disclosure. According to this aspect the locking mechanism includes a locking member 350 which is connected to the barrel portion 140 of the handle 106 and is movable in a direction substantially parallel to the cable axis CA. The locking member 350 includes a body 352 having a first end portion 354 and a second end portion 356. The first end portion 354 includes an outwardly extending tab 360 adapted to allow a user to move the locking member 350 between a locked position and an unlocked position. A ramp portion 362 is provided at the second end portion 356 of the body 352 and is adapted to engage the feed control device 110 and maintain the feed control device in the actuating position. As shown, the ramp portion 362 of the locking member 350 is at least partially interposed between the barrel portion 140 and the housing 170 of the feed control device 110. To allow for the axial movement of the locking member 350 on the barrel portion 140, the barrel portion includes an elongated projection 370. The projection is generally rectangular shaped and extends along the axis of the barrel portion 140. The body 352 of the locking member 350 includes a corresponding elongated opening 374 dimensioned to slidably receive the projection 370. To prevent the locking member 350 from separating from the barrel portion 140 at least a portion of the body 352 extends below the projection 370. Therefore, with this arrangement, the locking member 350 is connected to the projection 370 and is movable along a longitudinal extent of the projection.

To maintain the feed control device 110 in the actuating position, a user moves the locking member 350 to the locked position via the outwardly extending tab 360. The ramp portion 362 provided on the second end portion 356 of the body 352 is moved toward the driving mechanism 112. This wedges and frictionally engages the ramp portion 362 between the barrel portion 140 and the housing 170 and prevents the feed control device 110 from pivoting back toward the non-actuating position. To unlock the locking mechanism 120, a user depresses the trigger 174 toward the handle portion 142. This moves the housing 170 at least partially away from the ramp portion 362 allowing a user to move the locking member 350 to the unlocked position via the outwardly extending tab 360. The locking member 350 axially slides on the projection 370 toward the drum 102 and out of the space between the barrel portion 140 and the housing 170. The user can then release the trigger 174 and the feed control device 110 is moved back to the non-actuating position via the biasing force of the torsion spring 212.

FIGS. 11-14 depict a locking mechanism 120 according to yet another aspect of the present disclosure. As shown, the locking mechanism includes a locking member 400 rotatably connected to the handle portion 142. Similar to the previous embodiments, the locking member 400 includes a body 402 having a first end portion 404 and a second end portion 406 and an arcuate outer wall 408 extending between the end portions. A tab 410, 412 is provided at each respective end portion 404, 406 and extends outwardly from the body 402. The tabs allow a user to pivot or rotate the locking member 400 between a locked position and an unlocked position. A ramp portion 420 is provided on the body 402 of the locking member. As indicated previously, the locking member 400 is rotatably connected to the handle portion 142. To this end, an attachment member 430 is connected to an upper portion of the handle portion 142. The attachment member defines a mounting surface 432 for the locking member 400. A pivot pin 434 connects the locking member 400 to the attachment member 430. As depicted in the referenced figures, the locking member 400 can be pivoted about an axis, i.e., defined by the pin 434, which is preferably oriented transverse to the cable axis CA.

In an unlocked position of the locking member 400, the locking member is in a first position which locates the ramp portion 420 away from beneath the trigger 174. To maintain the feed control device 110 in the actuating position, the locking member 400 is rotated such that the ramp portion 420 is rotated into engagement with a lower portion of the feed control device 110. Particularly, with the feed control device 110 in the actuating position, rotation of the locking member 400 moves the ramp portion 420 into engagement with one of the planar edge sections 196, 198 provided on the side walls 192, 194 of the trigger 174. This frictional engagement between the ramp portion and the trigger 174 prevents the trigger from being biased away from the handle portion 142 via the torsion spring 212. To allow the feed control device 110 to move back towards the non-actuating position, the trigger is slightly depressed by the user which disengages the ramp portion 420 from the trigger 174. The locking member 400 can be rotated back to the unlocked position which moves the ramp portion 420 away from the feed control device 110. The trigger 174 can then be released by the user and the feed control device 110 moves back to the non-actuating position via the torsion spring 212.

Figure 15:
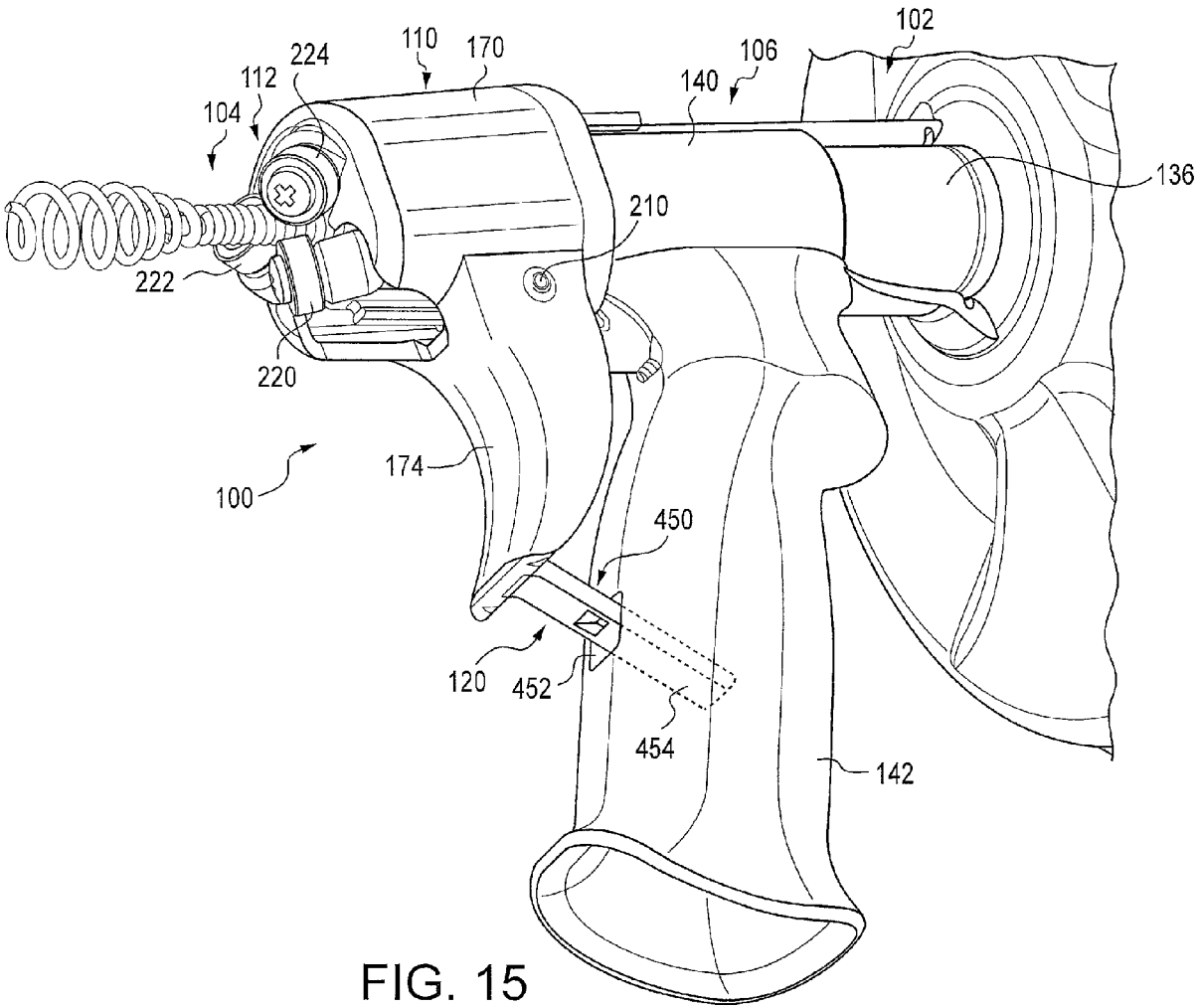
FIG. 15 is a partial side perspective view of the drain cleaner of FIG. 1 in an assembled condition, the drain cleaner being in a locked state via the locking mechanism including a locking member according to still yet another aspect of the present disclosure.
Figure 16:
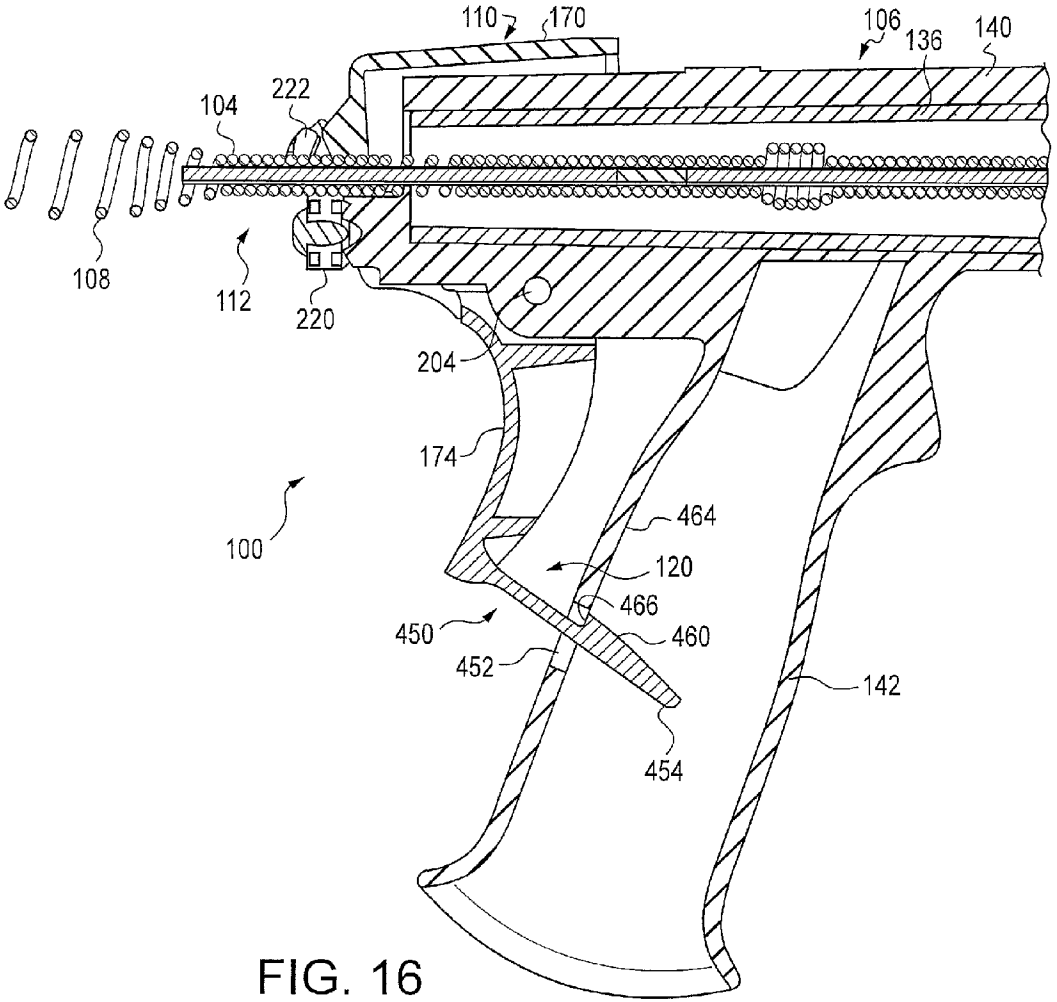
FIG. 16 is a cross-sectional view of the drain cleaner of FIG. 15.
Figure 17:
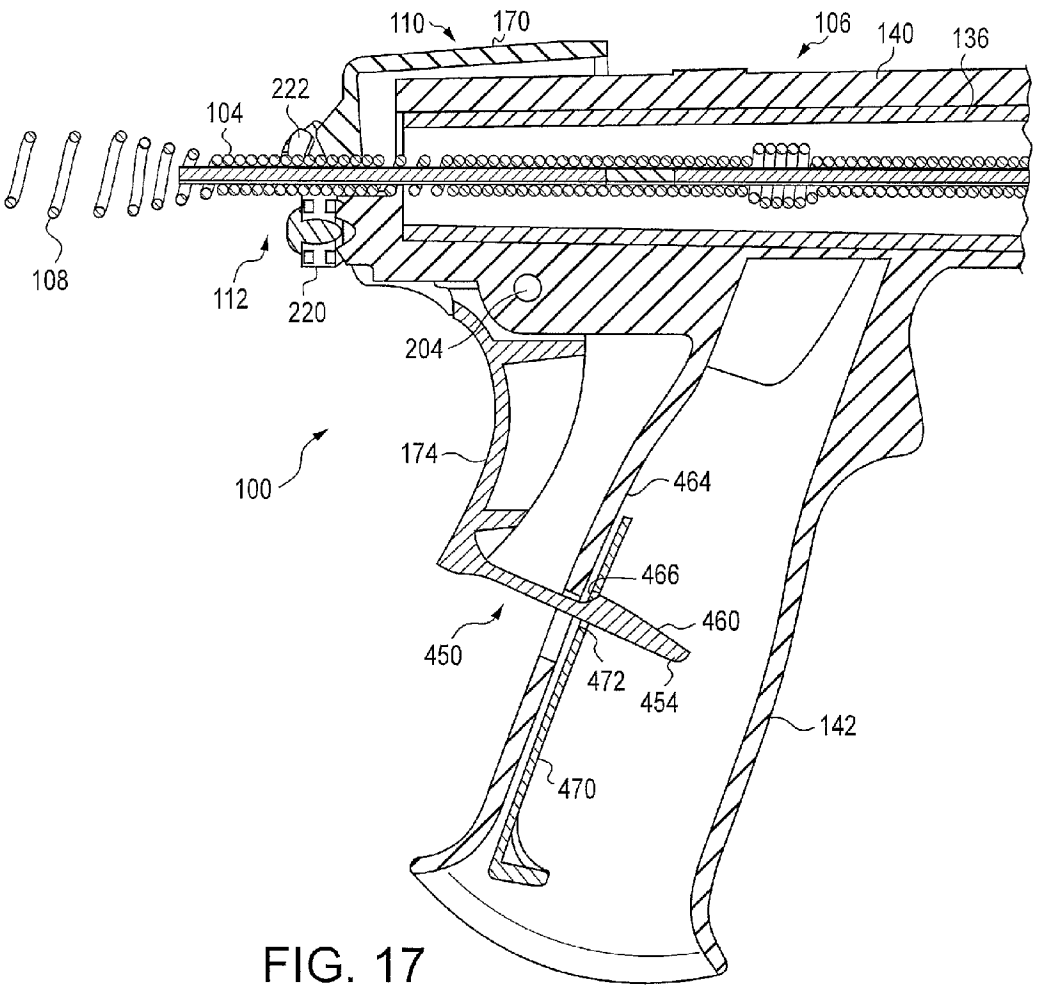
FIG. 17 is a cross-sectional view of the drain cleaner of FIG. 15 according to another embodiment of the locking mechanism shown in FIG. 15.

FIGS. 15-17 depict a locking mechanism 120 according to still yet another aspect of the present disclosure. As shown, the locking mechanism 120 includes a locking member 450 extending outwardly from a lower portion of the trigger 174 toward the handle portion 142 of the housing 106. The handle portion includes an opening 452 dimensioned to receive an end portion 454 of the locking member 450. The end portion 454 of the locking member includes a ramp portion 460 which is elevated toward the trigger 174. As depicted, the locking member 450 is integrally formed with the trigger 174 to define a one-piece unitary member; although, this is not required. As illustrated in FIGS. 15 and 16, to maintain the feed control device 110 in the actuating position, the end portion 454 of the locking member 450 is adapted to engage an inner portion 464 of the handle portion 142. Particularly, the ramp portion includes a wall 466. As the feed control device 110 is moved to the actuating position, the locking member 450 projects into the opening 452. In the actuating position of the feed control device 110, the locking member 450 is moved upwardly in the handle portion 142. When the trigger 174 is released by a user, the torsion spring 212 biases the feed control device 110 back toward the non-actuating position. However, as the feed control device begins to pivot, the wall 466 of the ramp portion 460 engages the inner portion 464 of the handle portion 142 thereby preventing further movement of the feed control device 110. To disengage the ramp portion 460 from the inner portion 464 and to allow the feed control device 110 to move back toward the non-actuating position, the trigger 174 is slightly depressed toward the handle portion 142 which disengages the ramp portion 460 from the inner portion 464. The locking member 450 can then be moved downwardly which allows the locking member 450 to move outwardly through the opening 452 as the feed control device 110 is moved from the actuating position to the non-actuating position.

As shown in FIG. 17, the locking mechanism 120 can further include a second locking member 470 located in the handle portion 142 and movable along the length of the handle portion. The second locking member 470 includes a hole 472 for receiving the end portion 454 of the locking member 450. According to one aspect, the second locking member 470 is configured to displace the end portion 454 of the locking member 450 in the handle portion 142 from a first position where the end portion 454 is freely movable through the opening 452 to a second position where the end portion is engaged to the inner portion 464 of the handle portion 142. Alternatively, and according to another aspect, the second locking member 470 is configured to secure the end portion 454 of the locking member 450 to the second locking member in the handle portion 142. According to this aspect, with the feed control device 110 in the actuating position, the second locking member 470 is displaced in the handle portion 142 and locks the end portion 454 in the handle portion 142 via engagement of the second locking member 470 with the ramp portion 460. To unlock the locking member 450, the second locking member is displaced in an opposite direction which disengages the second locking member 470 from the ramp portion 460 allowing the end portion 454 of the locking member 450 to move through the opening 472 provided in the second locking member 470 and the opening 452 provided in the handle portion 142.

Figure 18:
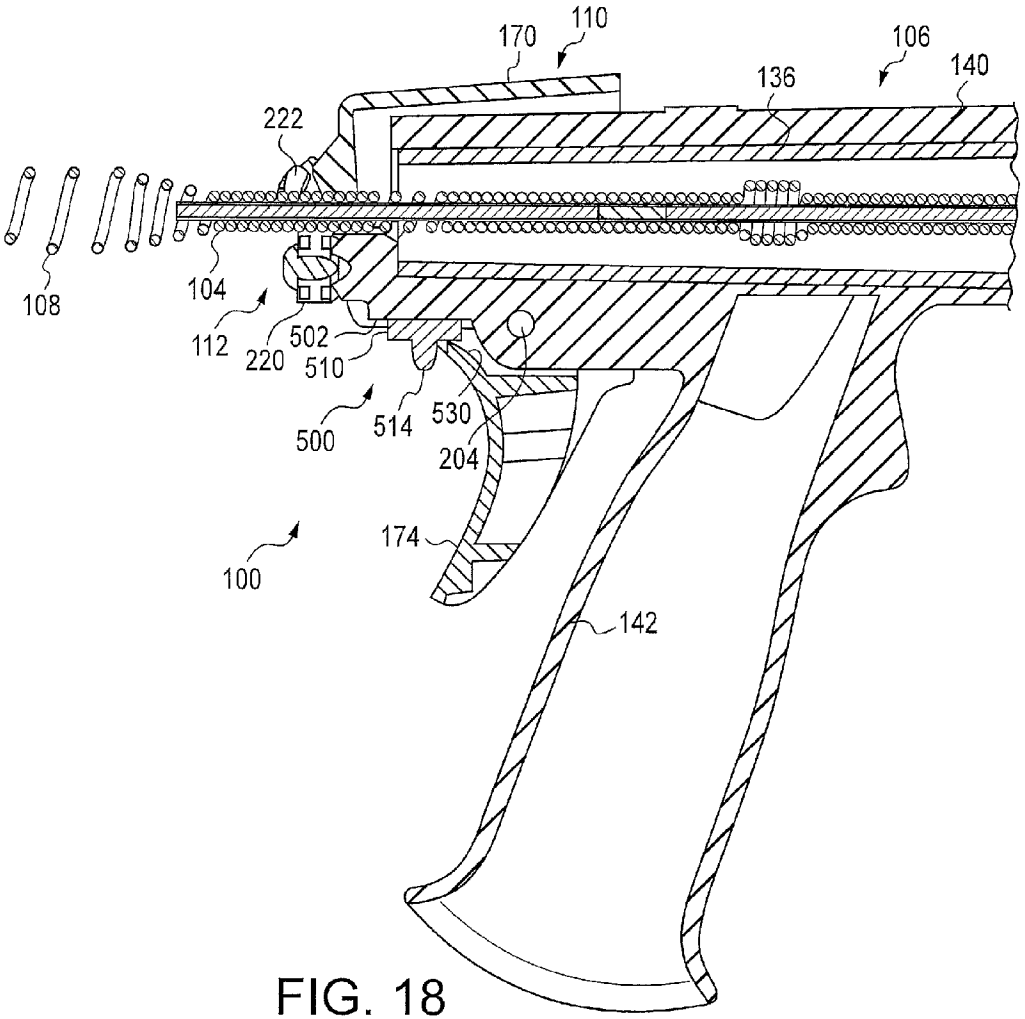
FIG. 18 is a cross-sectional view of the drain cleaner of FIG. 1 in an assembled condition, the drain cleaner being in a locked state via the locking mechanism including a locking member according to still yet another aspect of the present disclosure.

FIG. 18 depicts a locking mechanism 120 according to still yet another aspect of the present disclosure. As shown, a locking mechanism includes a locking member 500 movably connected to the barrel portion 140 of the handle 106 adjacent the trigger 174 of the feed control device 110. The barrel portion 140 includes an elongated projection 502 extending between the driving mechanism 112 and the handle portion 142. The projection 502 can have an inverted T-shape; although, this is not required. The locking member 500 includes a body 510 including an elongated opening (not shown) dimensioned to receive the projection 502 and a tab 514 extending outwardly from the body 510. As shown, the tab 514 is generally centrally located on the body 510 and is adapted to allow a user to move the locking member 500 in a direction substantially parallel to the cable axis CA along a longitudinal extent of the projection 502 between a locked position and an unlocked position. To that end, the projection 502 is slidably received in the elongated opening (not shown) with the body 510 further including fingers (not shown) which extend at least partially into the opening and engage an upper surface of the projection 502.

To maintain the feed control device 110 in the actuating position, a user moves the locking member 500 to the locked position via the outwardly extending tab 514. At least a portion of the body 510 of the locking member 500 is moved between the barrel portion 140 and an upper portion 530 of the trigger 174 thereby preventing the feed control device 110 from pivoting back toward the non-actuating position. To disengage the locking mechanism 500, the trigger 174 is slightly depressed toward the handle portion 142. This moves the upper portion 530 of the trigger away from the locking member 500 allowing a user to move the locking member 500 to the unlocked position via the outwardly extending tab 514. The locking member 500 axially slides on the projection 502 away from the drum 102 toward the driving mechanism 112 and out of the space between the upper portion 530 and the barrel portion 140. Upon subsequent release of the trigger 174, the feed control device 110 is pivoted back toward the non-actuating position via the biasing force of the torsion spring 212.

Figure 19:
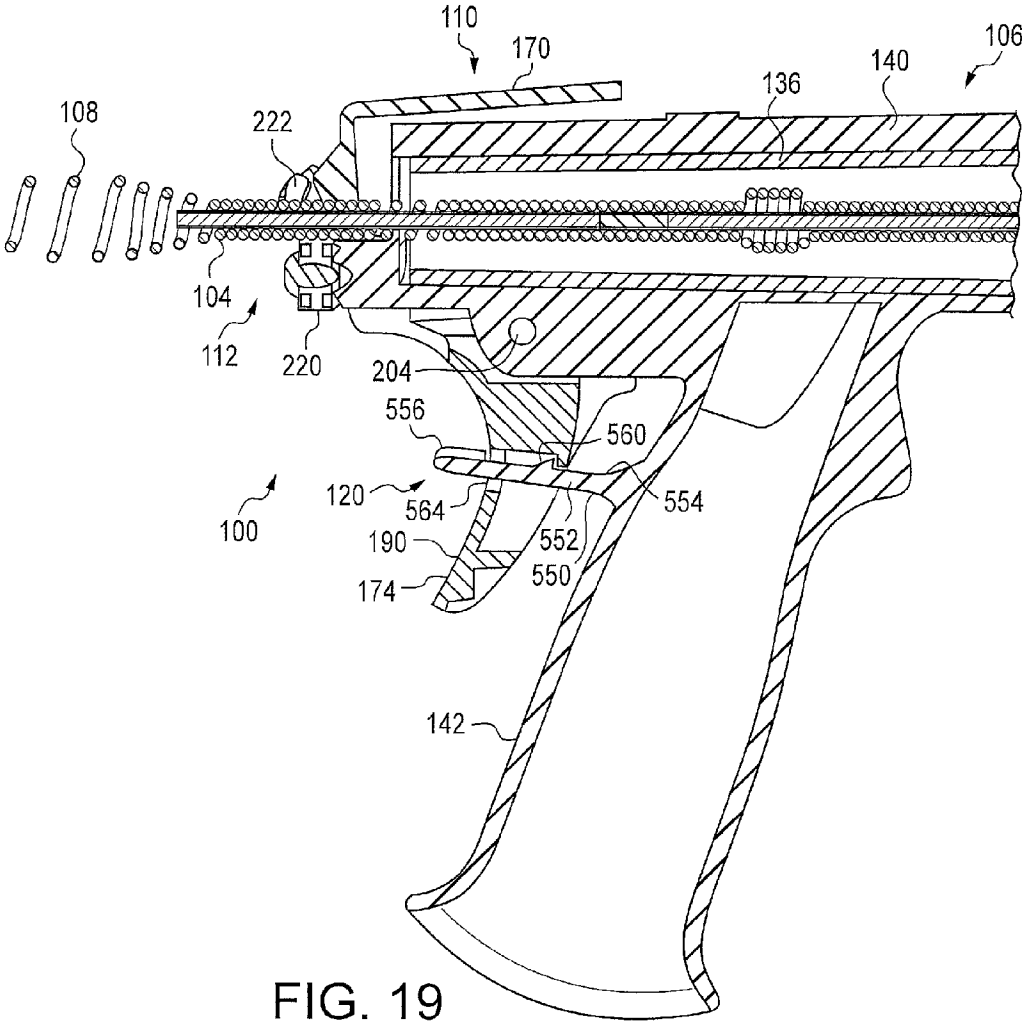
FIG. 19 is a partial cross-sectional view of the drain cleaner of FIG. 1 in an assembled condition, the drain cleaner being in a locked state via the locking mechanism including a locking member according to still yet another aspect of the present disclosure.

FIG. 19 depicts a locking mechanism 120 according to still yet another aspect of the present disclosure. As shown, the locking mechanism includes a locking member 550 including a body 552 having a first end portion 554 and a second end portion 556. The first end portion 554 of the body 550 is integrally formed with the handle portion 142 of the handle 106; although, this is not required. The body 552 includes a ramp portion 560 positioned between the first and second end portions 554 and 556. The second end portion 556 extends through an opening 564 provided on the trigger 174. As the feed control device 110 is moved to the actuating position, the second end portion 556 projects through the opening 564 until the ramp portion 560 is located outside of the opening. In the actuating position, the locking member 550 can be displaced upwardly such that the ramp portion engages the end wall 190 of the trigger. This engagement prevents the feed control device 110 from pivoting back towards the non-actuating position. To disengage the ramp portion 560 from the trigger 174, the trigger is slightly depressed towards the handle portion 142 of the housing 106. The locking member 550 can then be displaced downwardly so that the ramp portion 560 can move back through the opening 564 provided on the trigger 174. Upon release of the trigger 174, the feed control device 110 can be moved back towards the non-actuating position via the biasing force of the torsion spring 212. The body 552 of the locking member 550 then moves back through the opening 564.

Figure 20:
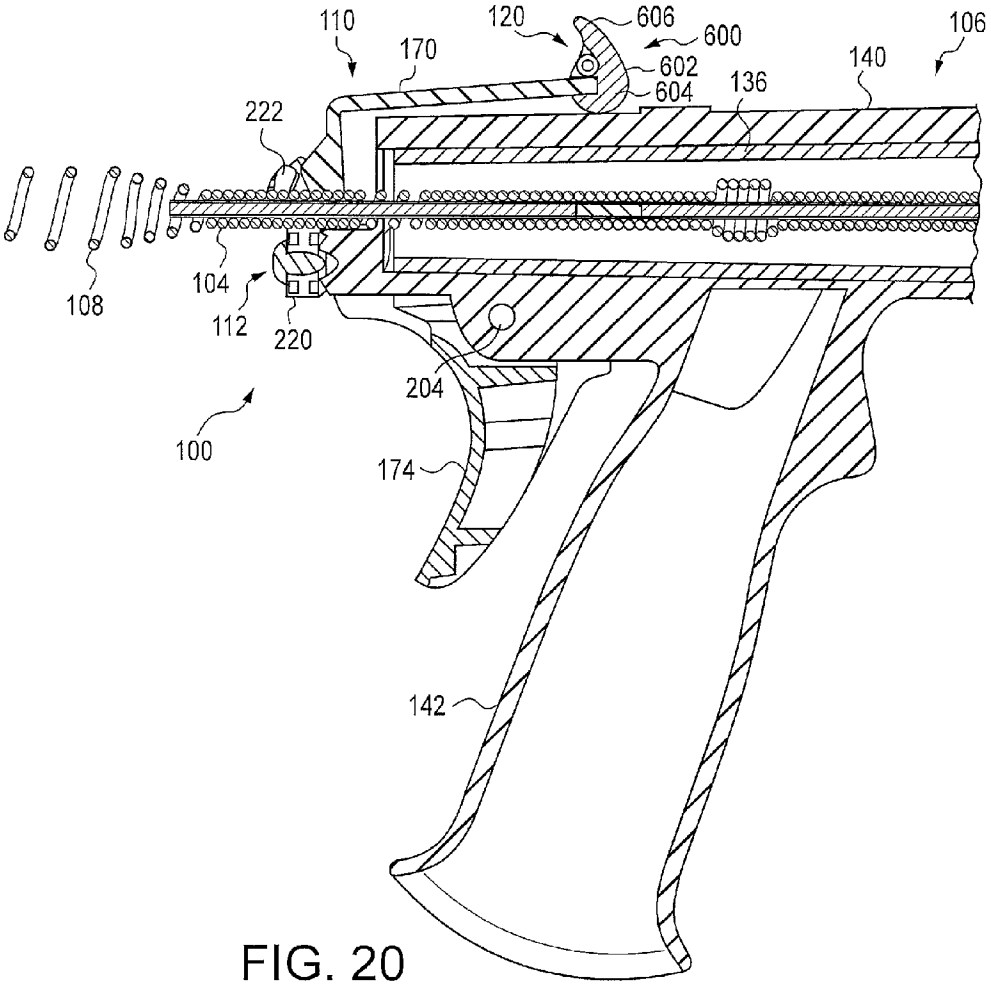
FIG. 20 is a partial cross-sectional view of the drain cleaner of FIG. 1 in an assembled condition, the drain cleaner being in a locked state via the locking mechanism including a locking member according to still yet another aspect of the present disclosure.
Figure 21:
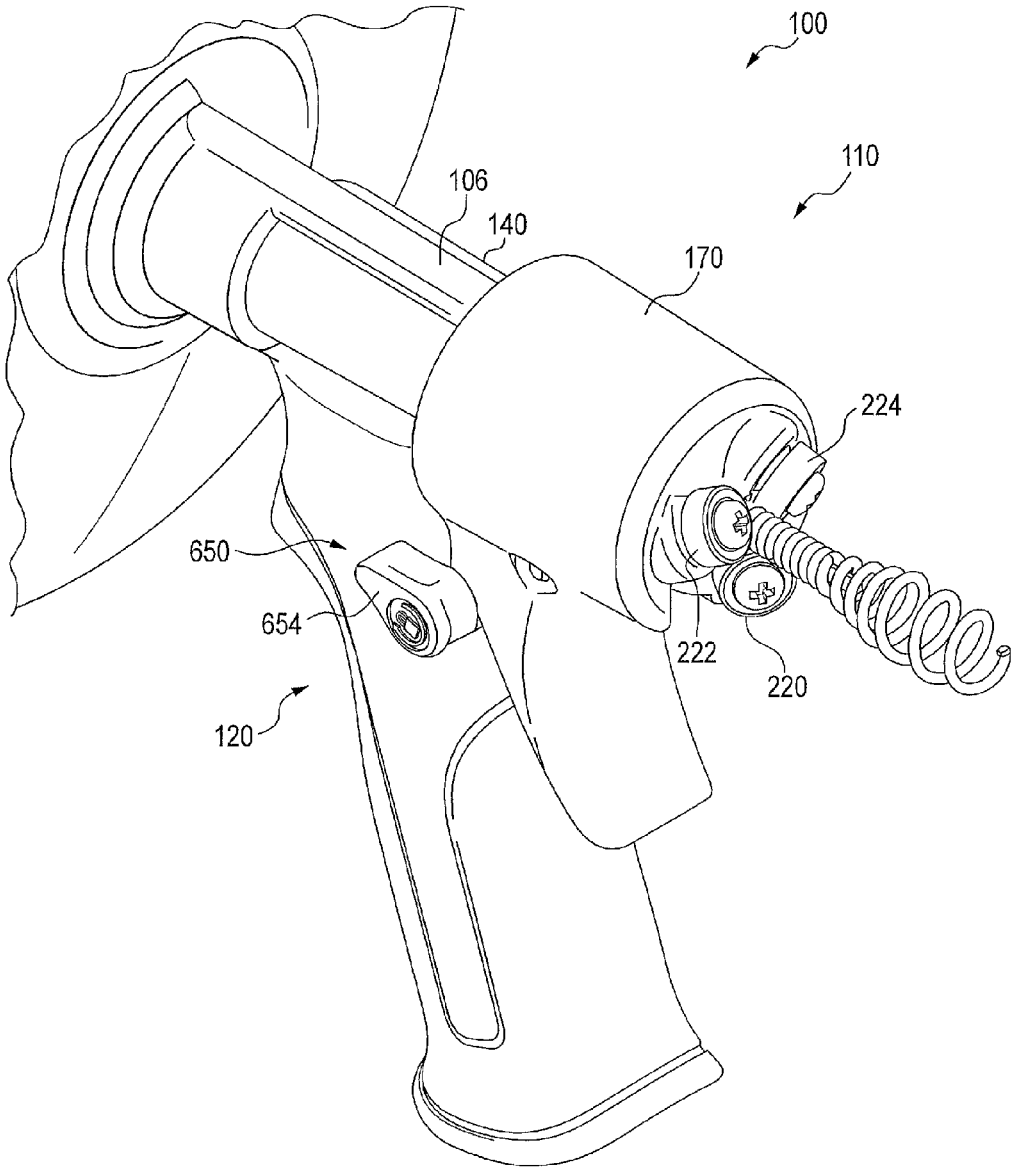
FIG. 21 is a partial front perspective view of the drain cleaner of FIG. 1 in an assembled condition, the drain cleaner being in an unlocked state, the locking mechanism including a pivoting cam member according to yet another aspect of the present disclosure.

FIG. 20 depicts a locking mechanism 120 according to still yet another aspect of the present disclosure. The locking mechanism includes a locking member 600 rotatably connected to the housing 170 of the feed control device 110 adjacent the barrel portion 140 of the handle 106. Preferably, the locking member 600 can be pivoted about an axis transverse to the cable axis CA. The locking member 600 includes a body 602 which at least partially defines a cam portion 604 and a finger portion 606. To maintain the feed control device 110 in the actuating position, the locking member 600 is rotated in a clockwise direction via the finger portion such that the cam portion 604 engages the barrel portion 140. This engagement prevents the feed control device 110 from moving back toward the non-actuating position. To release the locking member 600, the trigger 174 is depressed toward the handle portion 142. This disengages the locking member 600 from the barrel portion 140 and allows the locking member 600 to be rotated in a counter-clockwise direction which moves the cam portion 604 away from the barrel portion 140. Upon release of the trigger 174, the feed control device 110 is able to move back towards the non-actuating position via the biasing force of the torsion spring 212.

FIGS. 21-31 depict a locking mechanism 120 according to still another aspect of the present disclosure. The locking mechanism includes a pivoting cam member 650 rotatably engaged with the housing 170 of the feed control device 110 adjacent the barrel portion 140 of the handle 106. Preferably, the cam member 650 can be pivoted about an axis transverse to the cable axis CA. The cam member 650 includes a body 652 and a handle 654. In certain versions, the body 652 is in the form of a generally cylindrical body. At least one of the body 652 and the handle 654 defines one or more cam portions 656. In the particular version depicted in the referenced figures, the cam member 650 defines a first cam portion 656 adjacent or proximate a distal end 655 of the body 652, and a second cam portion 656 disposed adjacent or proximate the handle 654. For versions in which the body is cylindrical or generally so, the cam portions extend about at least a portion of the circumference of the body.

Figure 22:
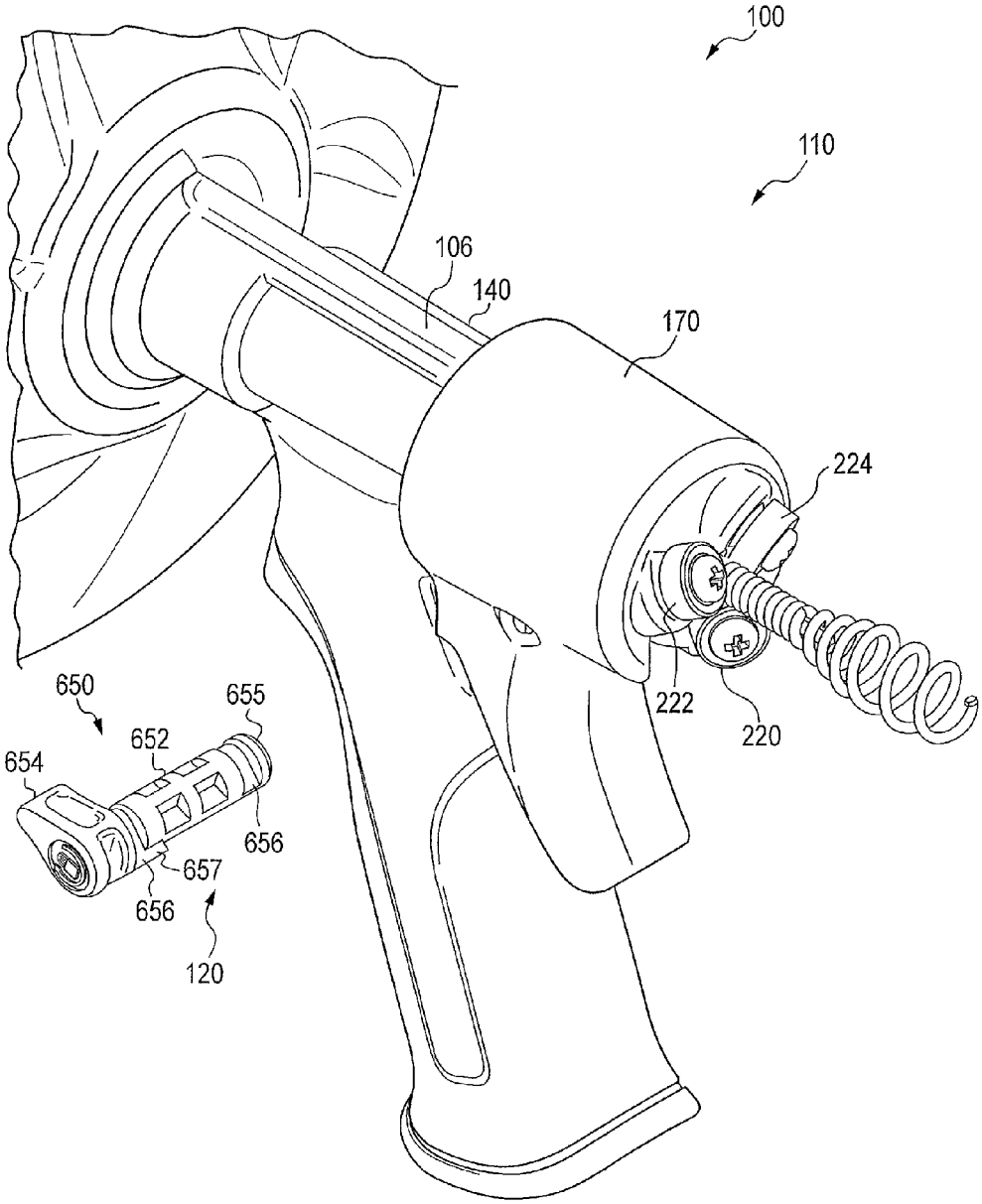
FIG. 22 is another partial front perspective view of the drain cleaner of FIG. 21 in a partially disassembled condition including the pivoting cam member utilized in the locking mechanism.
Figure 23:
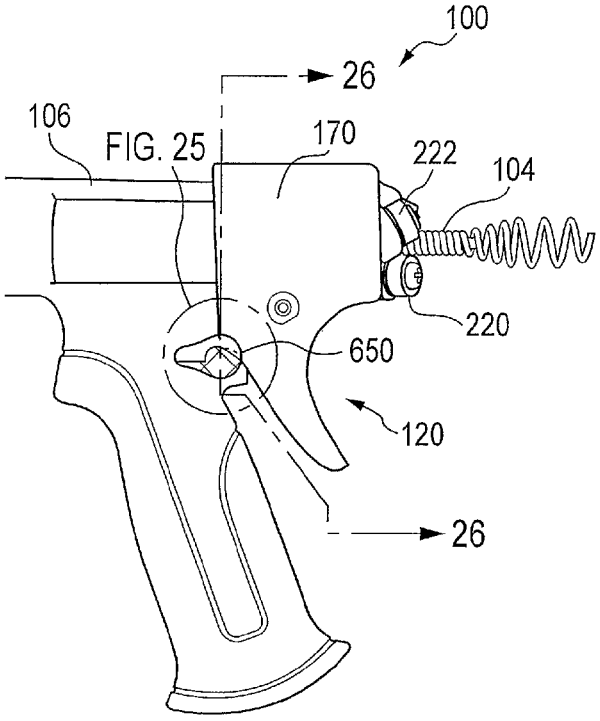
FIG. 23 is a partial side view of the drain cleaner of FIG. 21 in which the pivoting cam member is in an unlocked position.
Figure 24:
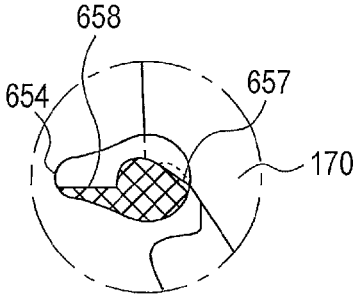
FIG. 24 is a detailed view of the pivoting cam member shown in FIG. 23 and further illustrating a camming surface.
Figure 25:
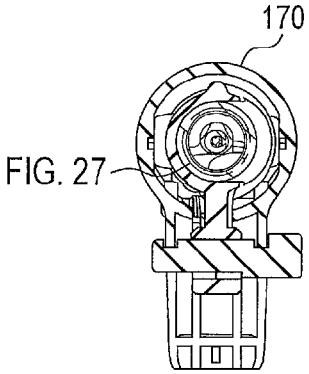
FIG. 25 is a cross sectional view of the drain cleaner of FIG. 23 taken along line 26-26 of FIG. 23.
Figure 26:
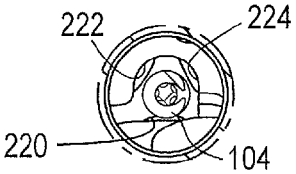
FIG. 26 is a detailed view of a central portion of the drain cleaner depicted in FIG. 25.
Figure 27:
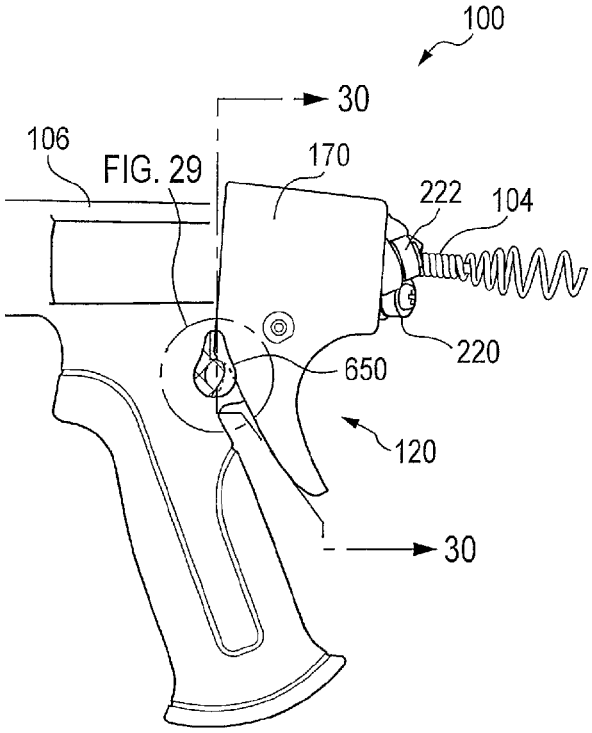
FIG. 27 is a partial side view of the drain cleaner of FIG. 21 in which the pivoting cam member is in a locked position.

FIGS. 23-26 illustrate various regions of the locking mechanism when the pivoting cam member 650 is in an unlocked position. In this position, the housing 170 is disengaged or otherwise free from the body 652 of the cam member 650 and in particular the cam portions 656. In this position, the top rollers 222 and 224 do not engage the cable 104. This configuration is depicted in FIG. 26. One or more biasing members such as torsional springs may be provided in association with the cam member 650 to bias or otherwise urge the cam member 650 to the unlocked state shown in FIG. 23. Moreover, a member, edge, or other component along the cam portion(s) 656 can be provided so as to prevent excessive rotation of the member 650. Referring to FIGS. 22 and 24, an outwardly extending edge 657 is depicted which upon positioning the cam member 650 to the position shown in FIG. 23, contacts the housing 170 to thereby preclude further rotation of the member 650.

Figure 28:
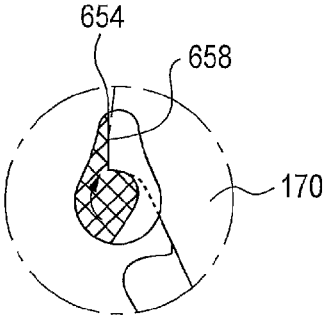
FIG. 28 is a detailed view of the pivoting cam member shown in FIG. 27 and further illustrating a camming surface.
Figure 29:
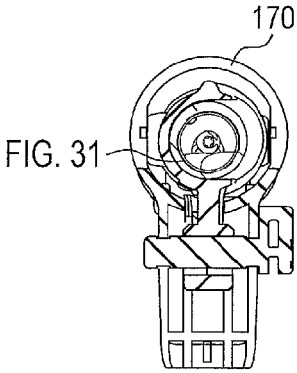
FIG. 29 is a cross sectional view of the drain cleaner of FIG. 27 taken along line 30-30 of FIG. 27.
Figure 30:
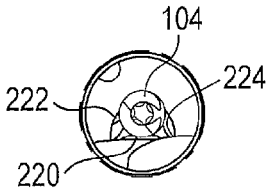
FIG. 30 is a detailed view of a central portion of the drain cleaner depicted in FIG. 29.
Figure 31:
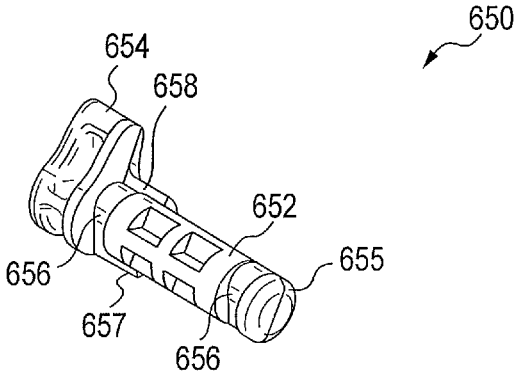
FIG. 31 is a perspective view of the pivoting cam member depicted in FIG. 22.

FIGS. 27-30 illustrate various regions of the locking mechanism 120 when the pivoting cam member 650 is in a locked position. The locking mechanism 120 is locked by rotating the cam member 650 such as for example to the position shown in FIG. 28. In the locked position, the housing 170 is engaged with the body 652 of the cam member 650 and in particular, with the cam portions 656 (as best shown in FIG. 22). In a locked position, the top rollers 222 and 224 engage the cable 104 as shown in FIG. 30. A lock stop ledge 658 (as best shown in FIG. 31) can be provided to prevent excessive rotation of the member 650 as shown in FIG. 28. The ledge 658 is configured to contact the housing 170 upon positioning or rotating the cam member 650 to the locked position shown in FIG. 27. Thus, in this particular embodiment, the cam member 650 includes an outwardly extending edge 657 generally in the form of a radially projecting edge disposed adjacent the handle 654, and a lock stop ledge 658 which is also in the form of a radially projecting ledge. The lock stop ledge 658 is typically located opposite the edge 657 and also disposed adjacent the handle 654. Although a variety of cam configurations could be employed, in the particular embodiment under review, upon rotation of the cam member 650 from the unlocked position shown in FIG. 23 to the locked position shown in FIG. 27, the cam portions 656 engage the housing 170 to the position shown in FIG. 27, thereby resulting in contact between the rollers and the cable as shown in FIG. 30.

As is evident from the foregoing, the present disclosure is directed to a feed control device 110 for a hand operated drain cleaner 100 in which maintenance of a user-applied force such as hand pressure, is not required. That is, upon appropriate selection of the feed control device, i.e. either for cable retraction or cable advancement, the user need not apply any grip or pressure in order to maintain that selection. The present disclosure provides several embodiments of locking mechanisms 120 holding the drain cleaner 100 in a locked state and an unlocked state for releasably engaging the drive actuating roll 220 and cable driving rolls 222, 224 of the driving mechanism 112 to the cable 104.

Many other benefits will no doubt become apparent from future application and development of this technology.

All patents, applications, and articles noted herein are hereby incorporated by reference in their entirety.

As described hereinabove, the present subject matter overcomes many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A manual or hand operated drain cleaner comprising:

a manually operated rotatable drum and an elongated flexible cable at least partially held in the drum, a portion of the elongated flexible cable extending from the drum having a cable axis, rotation of the drum rotating the cable portion about the cable axis;

a handle adapted to rotatably support the drum, the handle including a barrel portion and a handle portion, the barrel portion including a bore axially therethrough for receiving the cable;

a feed control device pivotally connected to the handle, the feed control device including a housing having a feed passage axially therethrough for receiving the cable, and a trigger for moving the feed control device between a non-actuating position and an actuating position;

a driving mechanism operably associated with one of the handle and the feed control device for selectively engaging the cable, wherein in the actuating position the feed control device is pivoted relative to the handle such that the driving mechanism engages the cable thereby inducing axial movement of the cable via rotation of the drum; and a locking mechanism operably associated with the feed control device, the locking mechanism being moveable between a lock position where the feed control device is locked in the actuating position and an unlocked position where the feed control device is freely moveable between the non-actuating position and actuating position.

2. The drain cleaner of claim 1, wherein the driving mechanism includes a drive actuating roll mounted on one of the handle and feed control device for rotation about a drive actuating roll axis and a pair of cable driving rolls each mounted on the other of the handle and feed control device for rotation about a cable drive roll axis, wherein the cable extends between the drive actuating roll and the cable driving rolls, and pivoting movement of the feed control device via the trigger from the non-actuating position to the actuating position displaces the pair of cable driving rolls toward the drive actuating roll, which, in turn, causes the cable to be engaged by the drive actuating roll and cable drive rolls, wherein the locking mechanism in the locked position maintains engagement between the drive actuating roll and cable drive rolls and the cable without a requirement of a user applying constant hand pressure on the trigger.

3. The drain cleaner of claim 1, wherein the locking mechanism includes a locking member moveably connected to the handle, the locking member including a ramp portion adapted to engage the feed control device and maintain the feed control device in the actuating position.

4. The drain cleaner of claim 3, wherein locking member includes a first ramp portion and a second ramp portion, the handle including a through hole and the locking member being slidably received in the through hole in a direction substantially perpendicular to the cable axis, wherein to maintain the feed control device in the actuating position each of the first and second ramp portions is moved into engagement a lower portion of the feed control device.

5. The drain cleaner of claim 4, wherein the handle further includes a keyway located in the through hole and the locking member includes a corresponding key which is slidably received in the keyway to prevent rotation of the locking member in the through hole.

6. The drain cleaner of claim 3, wherein the locking member is connected to the barrel portion of the handle and moveable in a direction substantially parallel to the cable axis, the ramp portion of the locking member being at least partially interposed between the barrel portion and the housing of the feed control device, wherein to maintain the feed control device in the actuating position the ramp portion is moved toward the driving mechanism.

7. The drain cleaner of claim 6, wherein the barrel portion includes an elongated projection and the locking member includes an elongated opening dimensioned to receive the projection, the locking member being connected to the projection and moveable along a longitudinal extent of the projection.

8. The drain cleaner of claim 3, wherein the locking member is rotatably connected to the handle portion, wherein to maintain the feed control device in the actuating position the ramp portion is rotated into engagement with a lower portion of the feed control device.

9. The drain cleaner of claim 1, wherein the locking mechanism includes a locking member moveably connected to the barrel portion of the handle adjacent the trigger of the feed control device, the barrel portion including an elongated projection extending between the driving mechanism and the handle portion, the locking member being moveable in a direction substantially parallel to the cable axis along a longitudinal extent of the projection, wherein to maintain the feed control device in the actuating position at least a portion of the locking member is moved between the barrel portion and an upper portion of the trigger thereby preventing the feed control device from pivoting back toward the non-actuating position.

10. The drain cleaner of claim 1, wherein the locking mechanism includes a locking member extending outwardly from the trigger toward the handle portion, the handle portion including an opening for receiving an end portion of the locking member, wherein to maintain the feed control device in the actuating position the end portion of the locking member is adapted to engage an inner portion of the handle portion.

11. The drain cleaner of claim 10, wherein the end portion of the locking member includes a ramp portion having wall for engaging the inner portion of the handle portion.

12. The drain cleaner of claim 10, wherein the locking mechanism further includes a second locking member located in the handle portion and movable along a length of the handle portion, the second locking member including a hole for receiving the end portion of the locking member.

13. The drain cleaner of claim 12, wherein second locking member is configured to displace the end portion in the handle portion from a first position where the end portion is freely moveable through the opening to a second position where the end portion is engaged to the handle portion.

14. The drain cleaner of claim 12, wherein the second locking member is configured to secure the end portion to the second locking member in the handle portion.

15. The drain cleaner of claim 1, wherein the locking mechanism includes a locking member extending outwardly from the handle portion toward the trigger, the trigger including an opening for receiving an end portion of the locking member, wherein to maintain the feed control device in the actuating position the end portion of the locking member is adapted to engage an outer portion of the trigger, wherein the end portion of the locking member includes a ramp portion having wall for engaging the outer portion of the trigger.

16. The drain cleaner of claim 1, wherein the locking mechanism includes a locking member rotatably connected to the housing of the feed control device adjacent the barrel portion of the handle, the locking member at least partially defining a cam portion, wherein to maintain the feed control device in the actuating position the locking member is rotated into engagement with the barrel portion.

17. The drain cleaner of claim 1, wherein the locking mechanism includes a locking member moveably connected to the handle, the locking member including a generally cylindrical body and at least one cam portion extending about at least a portion of the circumference of the body.

18. The drain cleaner of claim 17 wherein the locking member further includes a handle at one end of the body and defines a distal end opposite the handle, the at least one cam portion including a first cam portion proximate the distal end of the body and a second cam portion proximate the handle.

19. A manual or hand operated drain cleaner comprising:

a manually operated rotatable drum and an elongated flexible cable at least partially held in the drum, a portion of the elongated flexible cable extending from the drum having a cable axis, rotation of the drum rotating the cable portion about the cable axis;

a handle adapted to rotatably support the drum;

a feed control device pivotally connected to the handle, the feed control device moveable between a non-actuating position and an actuating position;

a driving mechanism operably associated with one of the handle and the feed control device for selectively engaging the cable, wherein in the actuating position the feed control device is pivoted relative to the handle such that the driving mechanism engages the cable thereby inducing for axial movement of the cable via rotation of the drum; and a locking mechanism operably associated with the feed control device, the locking mechanism being moveable between a lock position where the feed control device is locked in the actuating position and an unlocked position where the feed control device is freely moveable between the non-actuating position and actuating position, wherein the locking mechanism includes a locking member having a ramp portion adapted to engage one of the handle and the feed control device and maintain the feed control device in the actuating position.

20. The drain cleaner of claim 19, wherein the locking member is moveably connected to the handle and engages the feed control device in the actuating position.

21. The drain cleaner of claim 19, wherein the locking member is part of the feed control device and engages the handle in the actuating position.

22. A locking mechanism for a manual or hand operated drain cleaner, the drain cleaner including a manually operated rotatable drum for holding an elongated flexible cable and rotating a portion of the cable extending from the drum about the cable axis, a handle adapted to rotatably support the drum, a feed control device pivotally connected to the handle and movable between a non-actuating position and an actuating position, and a driving mechanism for engaging the cable and allowing for axial movement of the cable via rotation of the drum in the actuating position of the feed control device, the locking mechanism comprising:

a locking member configured to move between a lock position where the feed control device is locked in the actuating position and an unlocked position where the feed control device is freely moveable between the non-actuating position and actuating position, the locking member having a ramp portion adapted to engage one of the handle and the feed control device and maintain the feed control device in the actuating position.

23. A manual or hand operated drain cleaner comprising:

a manually operated rotatable drum and an elongated flexible cable at least partially held in the drum, a portion of the elongated flexible cable extending from the drum having a cable axis, rotation of the drum rotating the cable portion about the cable axis;

a handle adapted to rotatably support the drum;

a feed control device pivotally connected to the handle, the feed control device moveable between a non-actuating position and an actuating position;

a driving mechanism operably associated with one of the handle and the feed control device for selectively engaging the cable, wherein in the actuating position the feed control device is pivoted relative to the handle such that the driving mechanism engages the cable thereby inducing for axial movement of the cable via rotation of the drum; and a locking mechanism operably associated with the feed control device, the locking mechanism being moveable between a lock position where the feed control device is locked in the actuating position and an unlocked position where the feed control device is freely moveable between the non-actuating position and actuating position, wherein the locking mechanism includes a pivoting cam member having a generally cylindrical body and at least one cam portion extending about at least a portion of the circumference of the body.

24. The drain cleaner of claim 23 wherein the cam member further includes a handle at one end of the body and defines a distal end opposite the handle, the at least one cam portion including a first cam portion proximate the distal end of the body and a second cam portion proximate the handle.

* * * * *